US006832601B2

(12) United States Patent
Watanabe et al.

(10) Patent No.: US 6,832,601 B2
(45) Date of Patent: Dec. 21, 2004

(54) CONTROL DEVICE OF FUEL INJECTION VALVE

(75) Inventors: Tetsushi Watanabe, Tokyo (JP); Osamu Nishizawa, Tokyo (JP); Mitsunori Nishida, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/644,858

(22) Filed: Aug. 21, 2003

(65) Prior Publication Data

US 2004/0155121 A1 Aug. 12, 2004

(30) Foreign Application Priority Data

Jan. 28, 2003 (JP) ..... P2003-019187

(51) Int. Cl.[7] ..... F02M 51/00
(52) U.S. Cl. ..... 123/490; 123/480; 361/152
(58) Field of Search ..... 123/490, 480; 361/152, 153, 154, 155

(56) References Cited

U.S. PATENT DOCUMENTS 4,266,261 A * 5/1981 Streit et al. ..... 361/154
4,800,861 A * 1/1989 Oshizawa et al. ..... 123/506
6,557,532 B1 * 5/2003 Nakayama et al. ..... 123/490

FOREIGN PATENT DOCUMENTS

| | | |
|---|---|---|
| JP | 7-71639 | 3/1995 |
| JP | 7-269404 | 10/1995 |
| JP | 11-351039 | 12/1999 |
| JP | 2001-234793 | 8/2001 |

* cited by examiner

*Primary Examiner*—John T. Kwon
(74) *Attorney, Agent, or Firm*—Sughrue Mion, PLLC

(57) ABSTRACT

A control device of a fuel injection valve is capable of performing a stable fuel injection even if voltage variation takes place in battery, and performing evacuation operation against error in switching element or auxiliary power supply. The control device includes: an auxiliary power supply 6 for stepping up voltage of main power supply 1; a first switching element 20 for performing rapid power supply from auxiliary power supply 6 to electromagnetic solenoid 27; a second switching element 24 for performing continuous power feed from main power supply 1 to electromagnetic solenoid 27, and implementing ON/OFF control to perform holding power feed; a third switching element 26 for interrupting current of these power feeds; and a control device for controlling the power feeds. Power feed is normally performed in order of rapid power feed, continuous power feed and hold power feed.

20 Claims, 10 Drawing Sheets

【Fig.1】
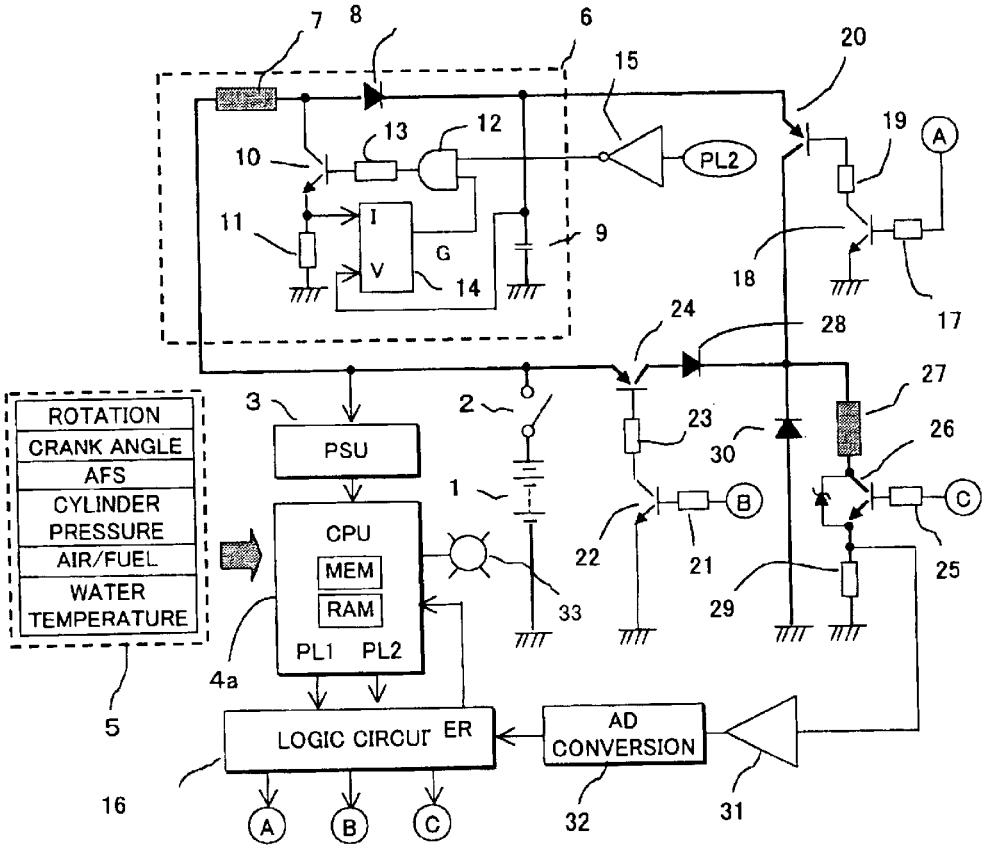

【Fig.2】
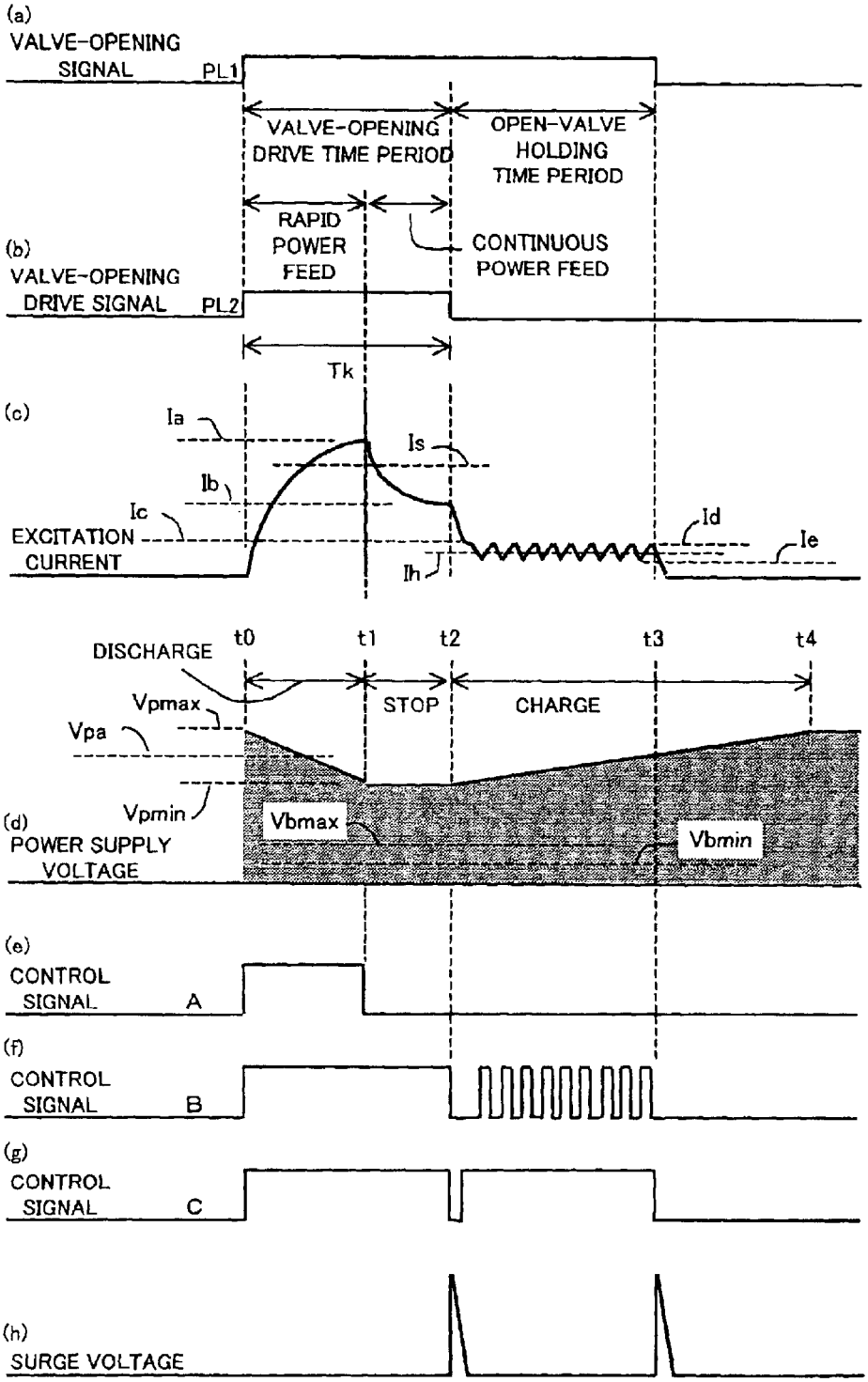

【Fig3】
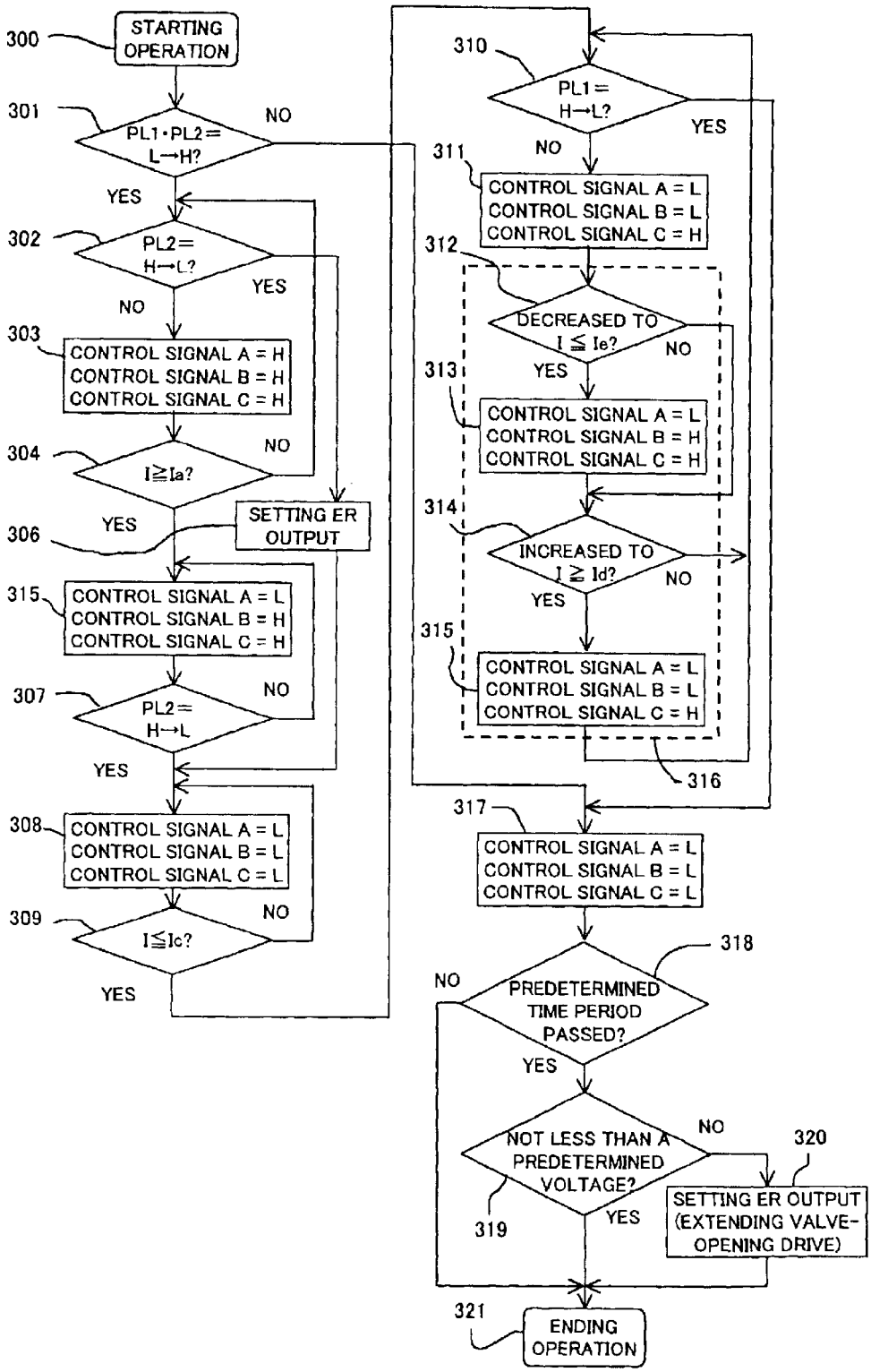

【Fig.4】
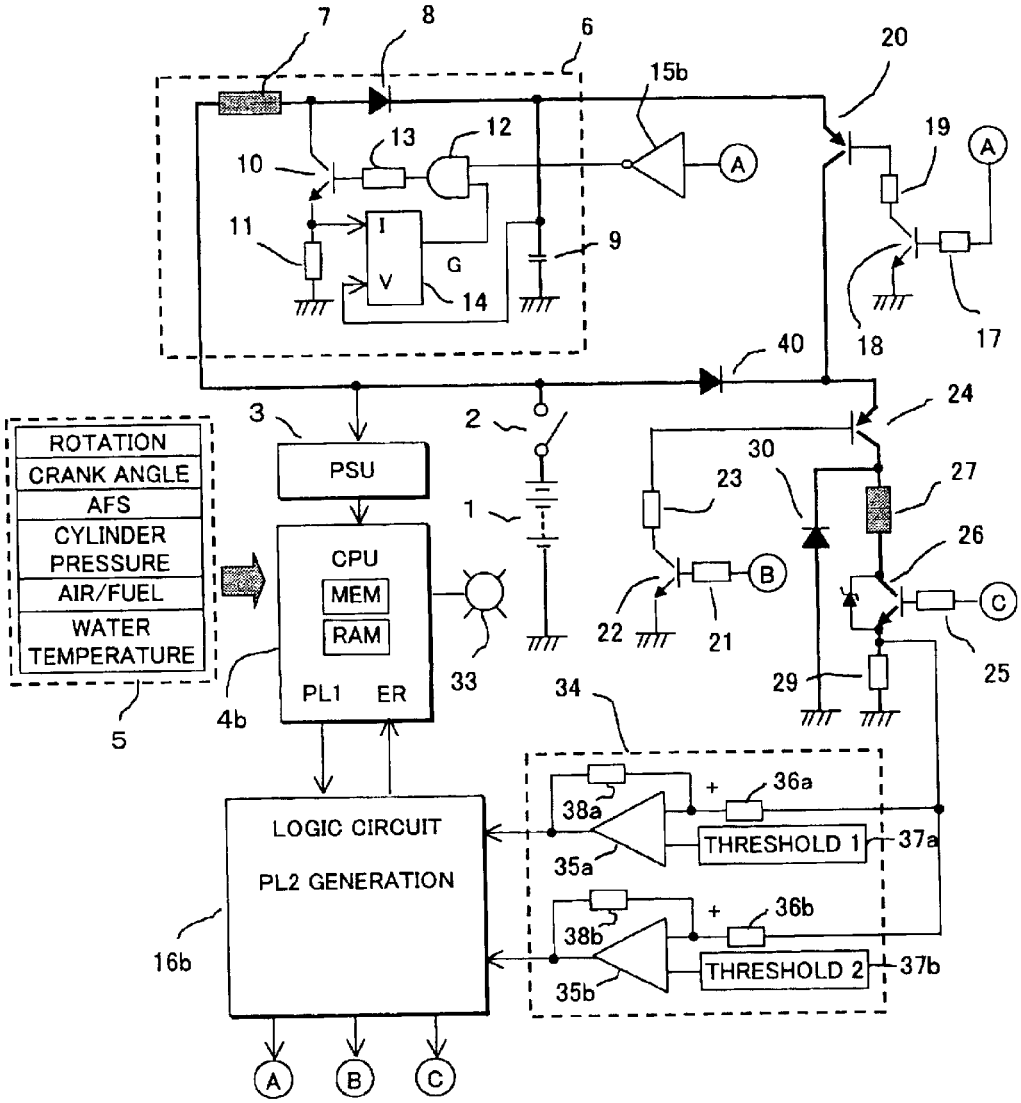

【Fig.5】
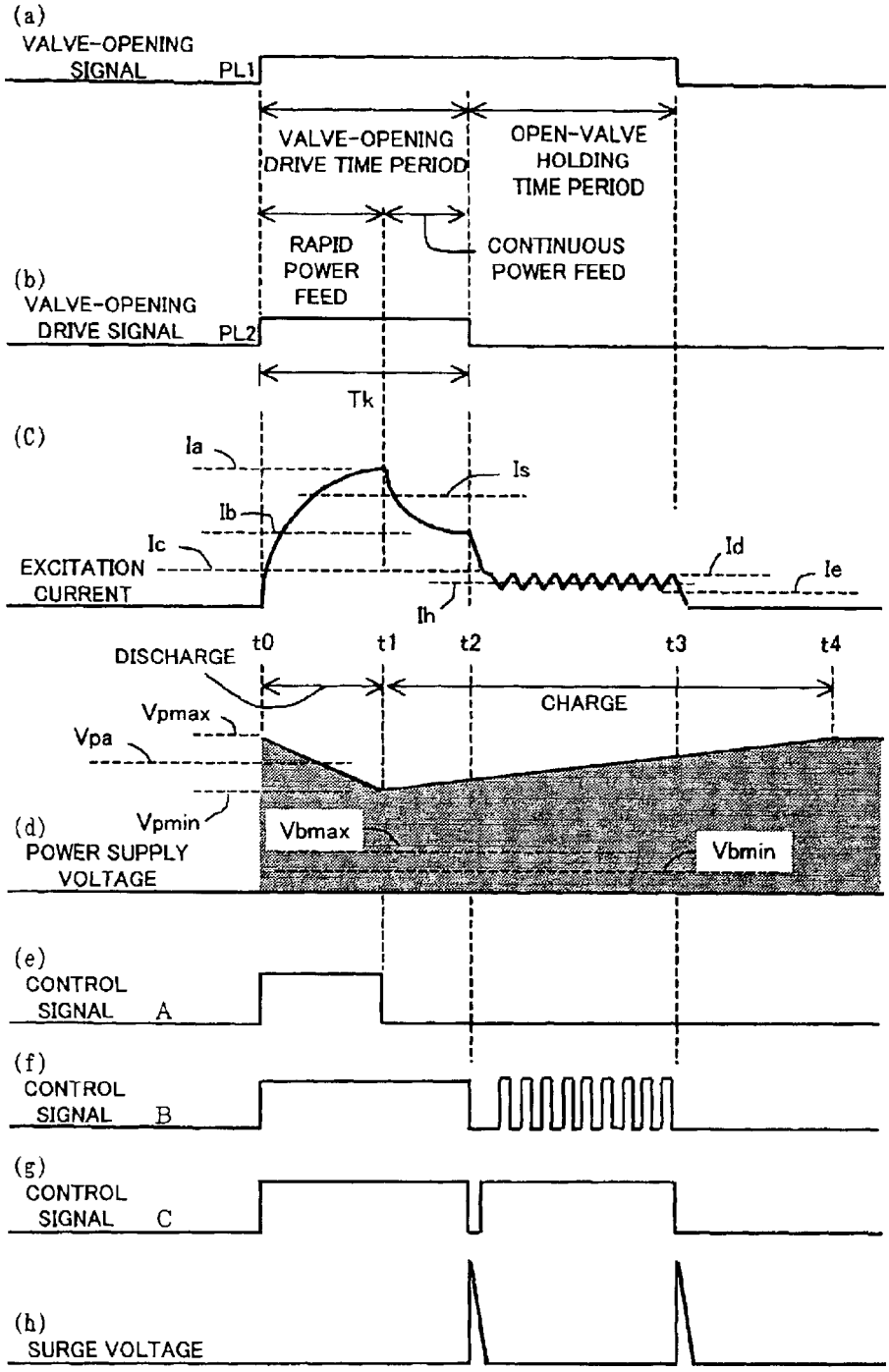

【Fig.6】
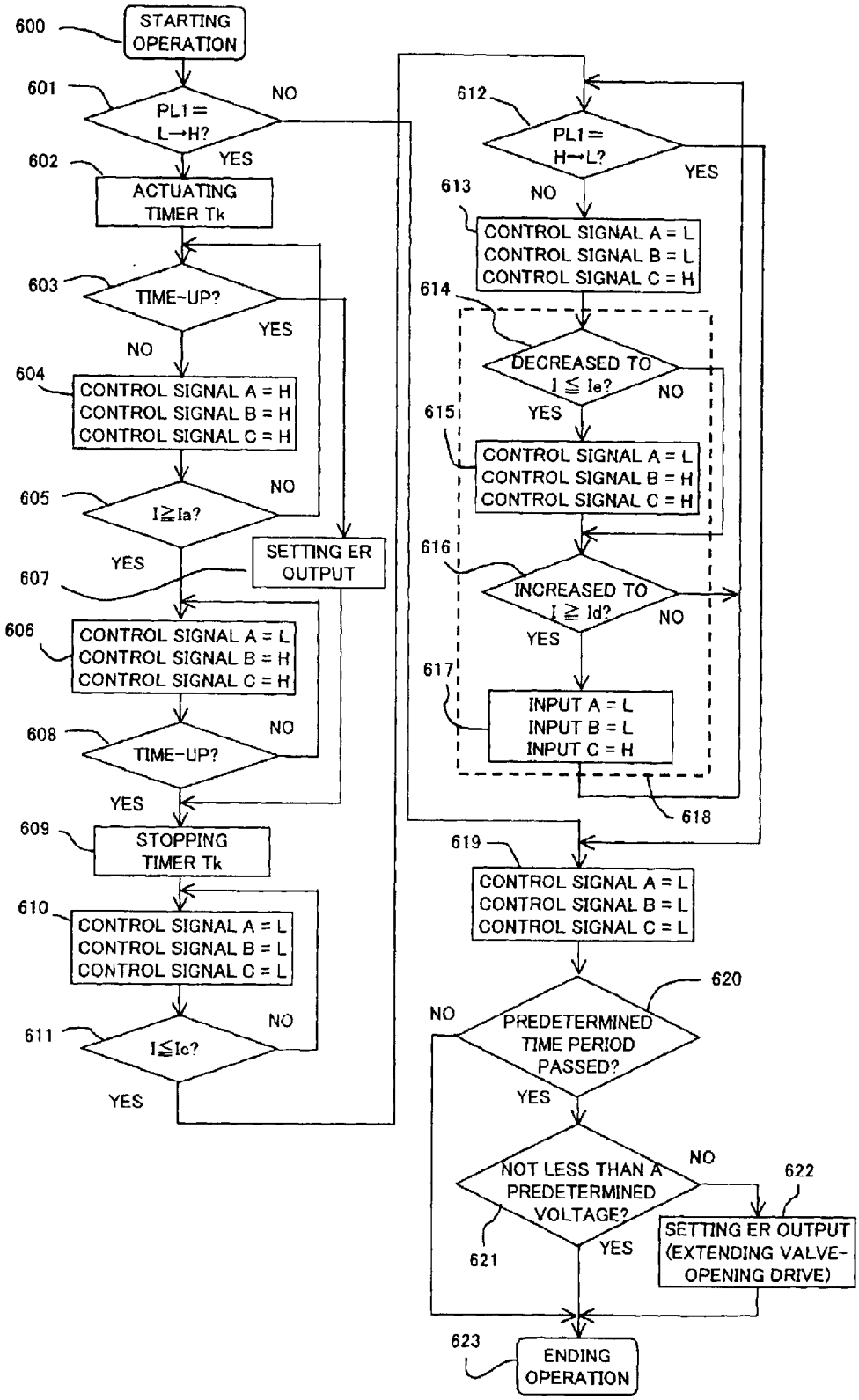

【Fig.7】
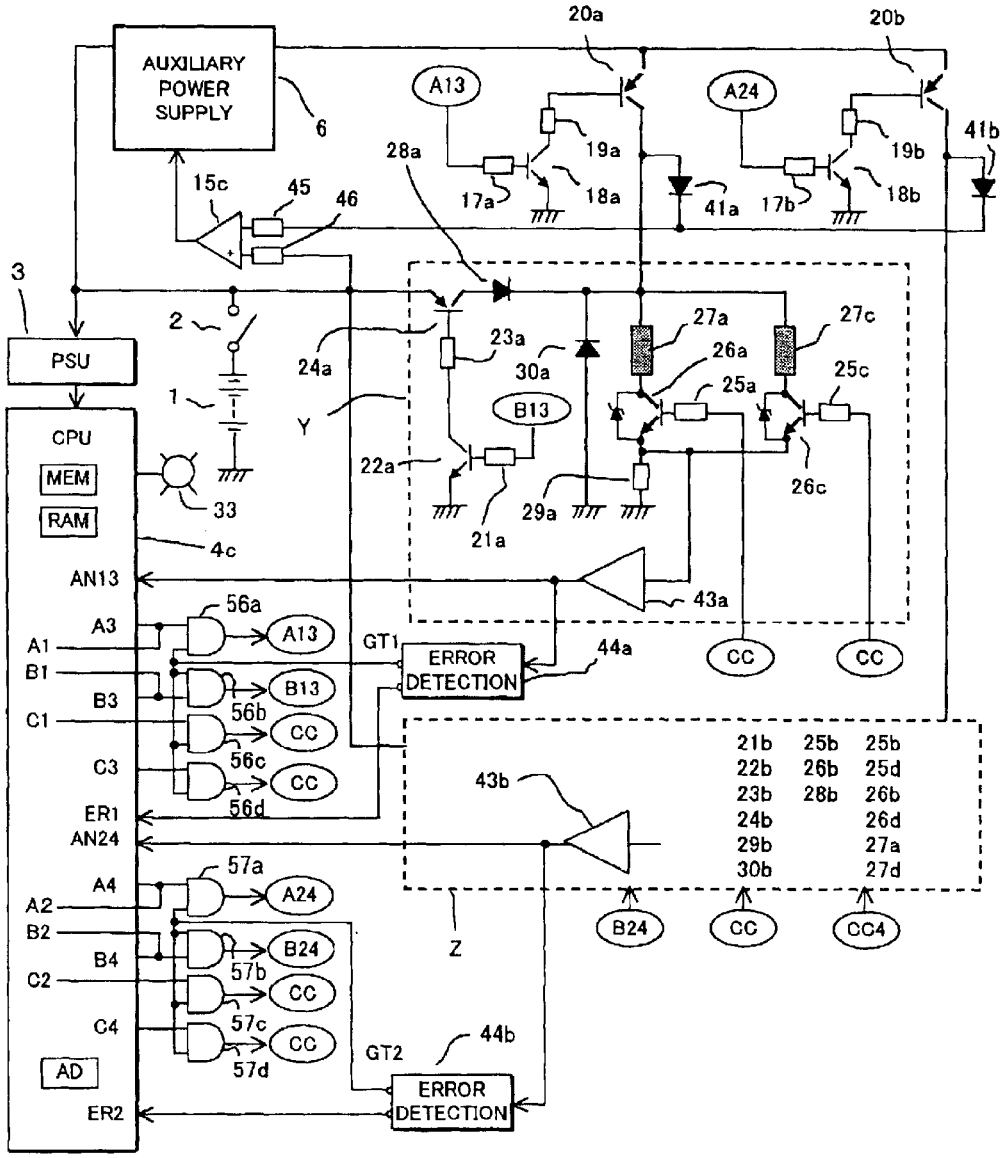

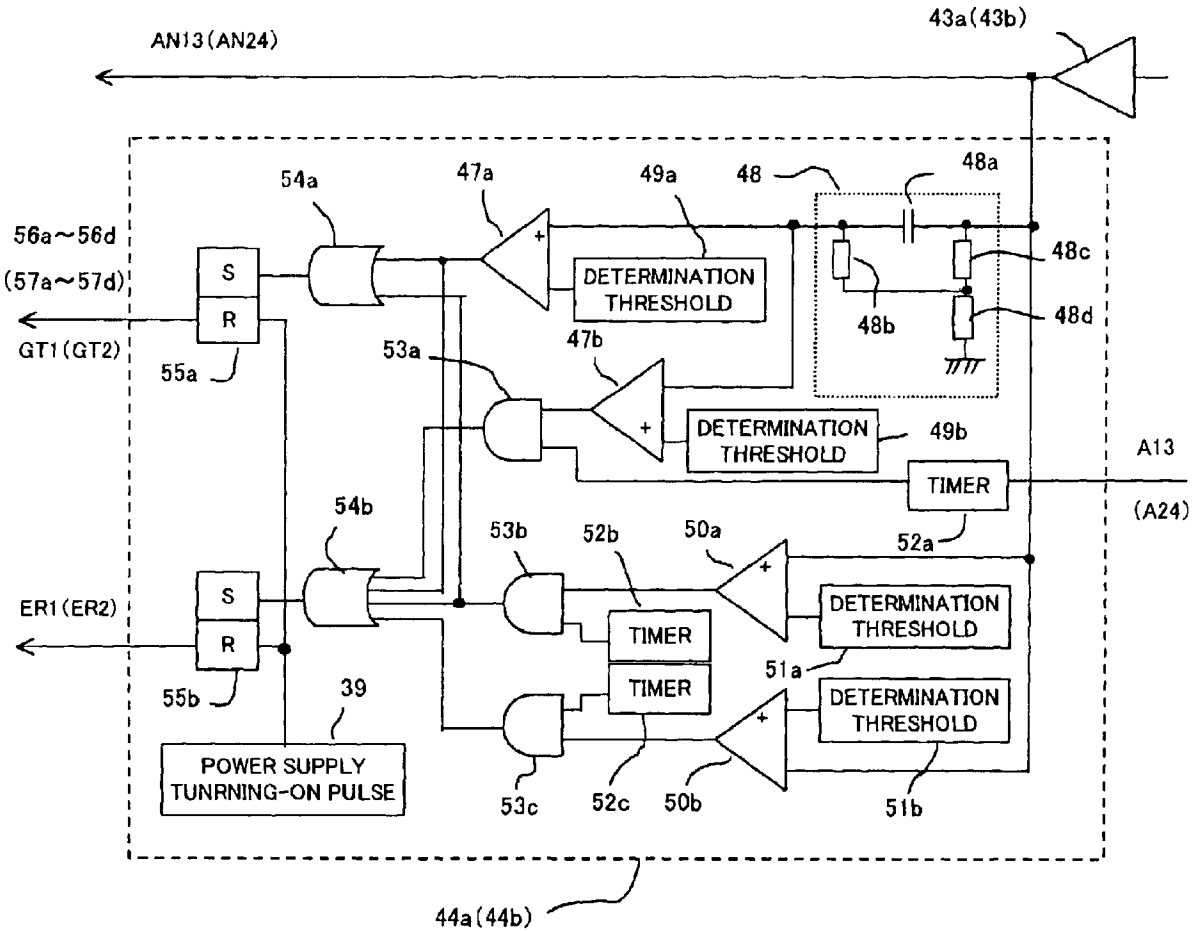
【Fig.8】

【Fig.9】
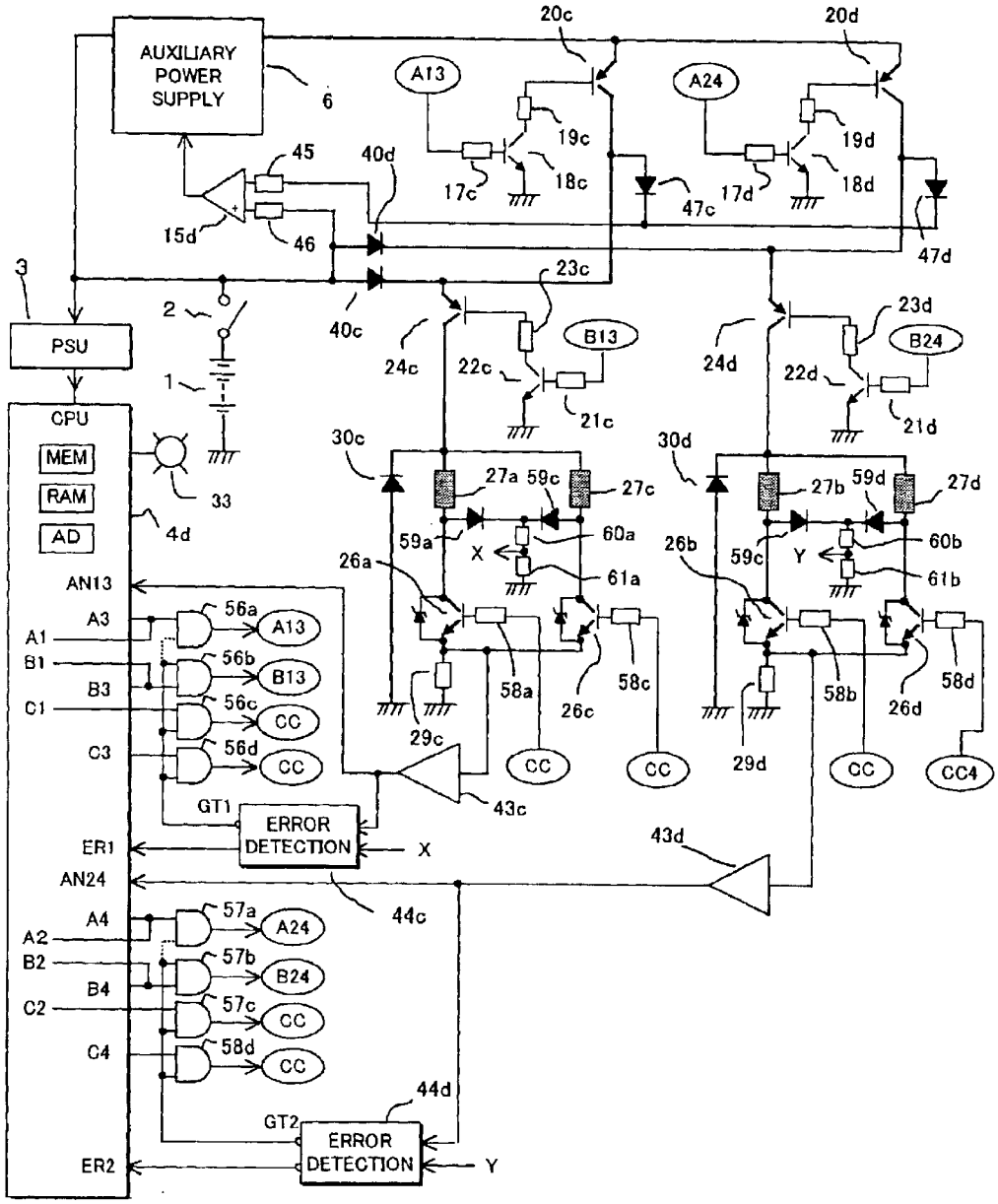

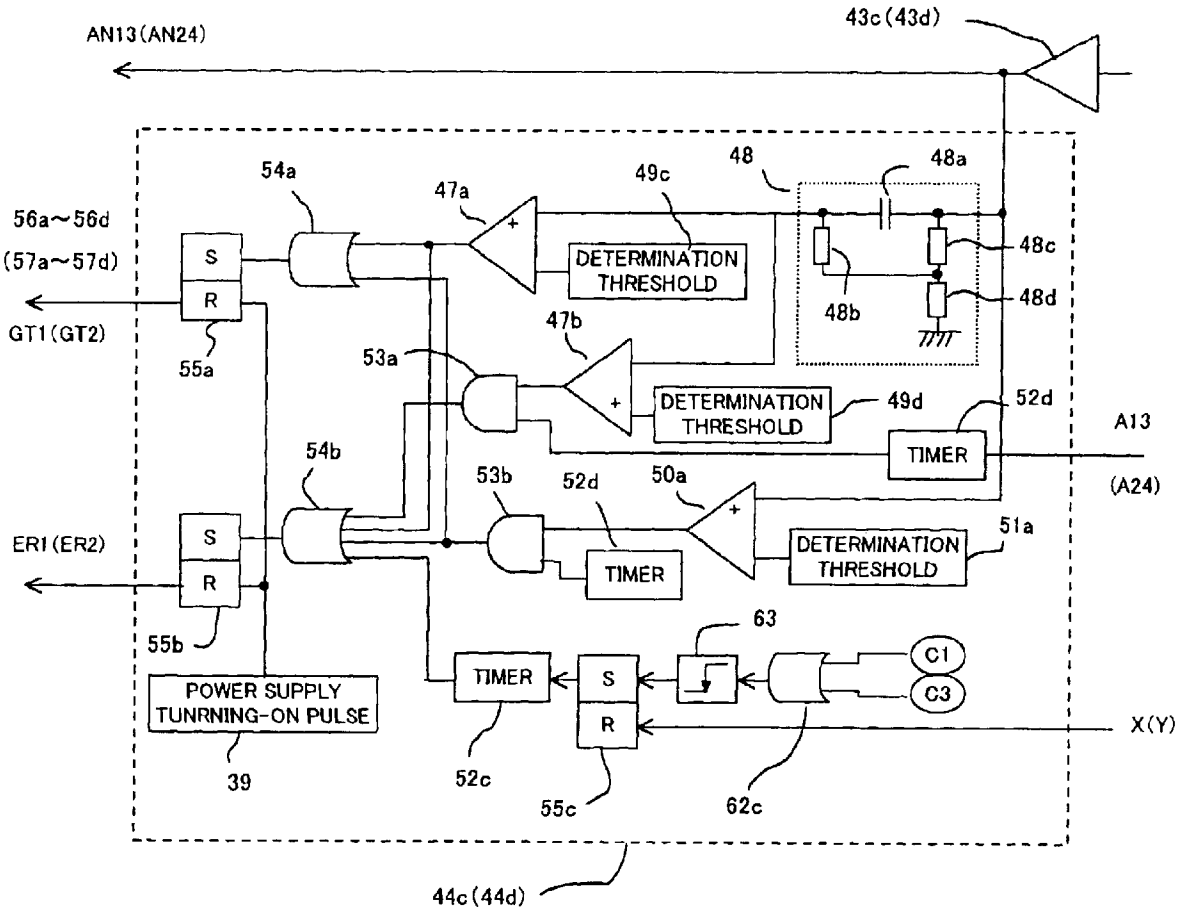
【Fig.10】

CONTROL DEVICE OF FUEL INJECTION VALVE

BACKGROUND OF THE INVENTION

1. Field of the Invention

The present invention relates to control of a fuel injection valve performing a fuel injection to an internal combustion engine for vehicle and, more specifically, to a control device of a fuel injection valve for driving the fuel injection valve at a high speed.

2. Description of the Related Art

A vehicle is generally mounted with: a sensor for detecting various information in accordance with operating conditions of an internal combustion engine; and control means that operates a valve-opening time and a valve-opening time period of a fuel injection valve on the basis of information from the sensor, and determines an amount of fuel to be supplied to the internal combustion engine to drive the fuel injection valve. This control means includes: valve-opening signal generation means for operating the above-mentioned valve-opening time and valve-opening time period to output an valve-opening signal; power feed control means for driving rapidly at a high voltage an electromagnetic valve of the fuel injection valve in response to the foregoing valve-opening signal and thereafter holding an open valve at a low current; and a power supply apparatus for supplying an electric power to the valve-opening signal generation means and power, feed control means and generating a drive electric power for the fuel injection valve. Hitherto, several attempts have been proposed in the field of arts as follows.

According to the art disclosed in the Japanese Patent Publication (unexamined) No. 71639/1995 (pages 2–4, FIG. 1), a battery power supply, a conduction control transistor and an electromagnetic valve are connected in series. Further provided is an auxiliary power supply for supplying a large current to the electromagnetic valve at the time of closing a circuit of the conduction control transistor. This auxiliary power supply consists of a voltage step-up DC—DC converter and a capacitor for charging a step-up DC voltage. During a predetermined time period at early times of conducting an electric power to the electromagnetic valve, the conduction control transistor is brought into a full conduction state to conduct a current from the auxiliary power supply as well as a current from a battery power supply. Thereafter, the conduction control transistor is subject to conduction control for constant current control. In this arrangement, a predetermined time period at early times of conduction is set to be a sum of a time period when a needle of the electromagnetic valve is full-lifted and a time period when no bound of the needle is observed.

According to the art disclosed in the Japanese Patent Publication (unexamined) No. 234793/2001 (pages 4–6, FIGS. 1 and 2), an electromagnetic valve is provided with: a power feed circuit from a capacitor that charges a step-up DC voltage by means of a voltage step-up DC—DC converter; a power feed circuit from a battery power supply including a back-flow prevention diode; and a current control element for ON/OFF controlling a current flowing through the electromagnetic valve. To this current control element, a current detection resistor is connected in series. First, a step-up voltage is applied to the electromagnetic valve in response to a valve-opening signal, and the electromagnetic valve is driven at a large current. When this current is lowered to a predetermined value, the power feed is switched to be fed from the battery power supply, and a constant current is conducted in response to outputs from the current detection resistor. An electromagnetic energy of the electromagnetic valve when the current control element is OFF is refluxed to the capacitor by means of the diode.

According to the art disclosed in the Japanese Patent Publication (unexamined) No. 351039/1999 (pages 4–6, FIGS. 1 through 3), an electromagnetic valve is driven at a large current at early times of driving, and thereafter driven at a constant current for a predetermined time period. In this known art, a constant voltage circuit outputting a constantly high voltage and a large capacity of capacitor to be charged by this constant voltage circuit are employed as a power supply for driving the electromagnetic valve at a large current level. Further, by automatically performing charge of the capacitor without regard to whether the electromagnetic valve is ON/OFF, opening the valve driven at a large current level can be conducted up to a region of high-speed rotation.

According to the art disclosed in the Japanese Patent Publication (unexamined) No. 269404/1995 (pages 4–6, FIG. 1), an electromagnetic valve is driven by: peak current supply means for conducting a peak current for opening the valve at a high speed upon start-up of the conduction; and holding current supply means for conducting a holding current smaller than the peak current after the peak current has been conducted. In this known art, fault is determined from a charging voltage of a capacitor that charges a step-up voltage, when a step-up circuit for conducting the peak current is faulty. Upon determination of a fault, a valve-opening time is made earlier, and a valve-opening time period is increased, thereby leading to prevention of engine stall.

Among the conventional arts as described above, the art disclosed in the Japanese Patent Publication (unexamined) No. 71639/1995 (pages 2–4, FIG. 1) intends to assist a valve-opening drive energy and reduce load on a high-voltage auxiliary power supply by not solely depending on a step up voltage having been charged at a capacitor in order to get a drive energy for a predetermined time period at early times of conduction to an electromagnetic valve, but also bringing the conduction control transistor into a state of a full conduction to feed the whole voltage from a battery. However, there is no switching means between the capacitor and the electromagnetic valve, and therefore charging to the capacitor cannot be performed during valve open holding time period. Thus, a problem exists in that any follow-up to a region of rotation at a high speed is hard to do, as well as valve-opening drive energy significantly varies due to voltage of the battery resulting in instability of fuel injection characteristic.

In the art disclosed in the Japanese Patent Publication (unexamined) No. 234793/2001 (pages 4–6, FIGS. 1 and 2), since the switching element supplying a high voltage from a capacitor and the switching element applying voltage from a battery are provided, it is certain that sharing of a drive energy at the time of opening the valve is performed with accuracy. An object of this known art, however, is to return to a capacitor an electromagnetic energy having been charged at the electromagnetic valve. Thus a problem exits in that accuracy in controlling a holding current by means of a current control element decreases. That is, a feed current to the electromagnetic valve flows to a current detection resistor as it is when the current control element is in conduction. On the other hand, an induction current of the electromagnetic valve flows dividedly to the capacitor and the current detection resistor when the current control element is in a state of open circuit. Therefore, detection current at the current detection resistor is not coincident with a current flowing through the electromagnetic valve. Further, ripple of the current flowing through the electromagnetic valve becomes larger when the current control element is ON/OFF, and it is necessary that a holding current is kept at a sufficient level in order to hold an open valve without fail. As a result, heat generation at the electromagnetic valve or current control element is increased, and energy loss is increased.

In the art disclosed in the Japanese Patent Publication (unexamined) No. 351039/1999 (pages 4–6, FIGS. 1 through 3). In the same manner as in the Japanese Patent Publication (unexamined) No. 234793/2001, switching elements are separately provided so that sharing a drive energy at the time of opening the valve is performed with accuracy. The current flowing through the electromagnetic valve returns to a communicating diode at the time of constant current control in order to hold valve open. Further provided is a switching element for interrupting an excitation current to, the electromagnetic valve at a high speed. However, in the case of occurrence of any short-circuit error that is incapable of opening a circuit of a transistor for applying a high voltage to the electromagnetic valve, the switching element is brought into an open circuit under the application state of the high voltage. Hence, a problem exists in that the switching element is liable to be damaged due to high withstanding voltage and, as a result, a solenoid of the electromagnetic valve is in danger of being burnt out.

In the art disclosed in the Japanese Patent Publication (unexamined) No. 269404/1995 (at pages 4–6, in FIG. 1), valve-opening drive is performed with a holding current by advancing the valve-opening time while extending the valve-opening time period even if it is impossible to supply the peak current. Accordingly, a problem exists in that the holding current needs to be set at an extremely great current value as compared with current required for merely holding the valve open, resulting in a larger heat generation at the electromagnetic valve. Moreover, suppression of this heat generation makes it impossible to apply a sufficiently high voltage under normal conditions to open the valve at a high speed.

SUMMARY OF THE INVENTION

The present invention was made to solve the above-discussed problems, and has an object of accomplishing a stable fuel injection in spite of voltage variation in a battery to act as a main power supply and preventing burnout and fire due to abnormal heating in spite of occurrence of short circuit fault in current control element. Another object of the invention is to obtain a control device for controlling a fuel injection valve capable of performing a reliable evacuating operation even if a high voltage auxiliary power supply for performing the rapid power feed comes to be in fault.

To accomplish the foregoing objects, a control device for controlling a fuel injection valve according to the invention includes:

an auxiliary power supply for stepping up voltage from a main power supply mounted on a vehicle;

a first switching element for conducting voltage from the auxiliary power supply to an electromagnetic solenoid for driving a fuel injection valve;

a second switching element for conducting voltage from the main power supply to the electromagnetic solenoid;

a third switching element that possesses a withstanding voltage limiting characteristic larger than a maximum output voltage from the auxiliary power supply, and interrupts a supply current to the electromagnetic solenoid at a high speed;

current detection means for detecting conduction current to the electromagnetic solenoid;

valve-opening signal generation means for inputting an operation information of an internal combustion engine and outputting a valve-opening signal and a valve-opening drive signal corresponding to a valve-opening time and a valve-opening time period of the fuel injection valve; and conduction control means for controlling a power feed to the electromagnetic solenoid in response to a signal of the valve-opening signal generation means.

In the mentioned control device for controlling a fuel injection valve, the conduction control means performs a rapid power feed from the auxiliary power supply to the electromagnetic solenoid by means of the first switching element in response to the valve-opening drive signal from the valve-opening signal generation means. Subsequently, the conduction control means performs a continuous power feed from the main power supply by means of the second switching element. Further, the conduction control means performs a hold power feed under ON/OFF control of the second switching element by feedback control based on a current value detected by the current detection means during continuance of the valve-opening signal after the valve-opening drive signal has ended. Furthermore, the conduction control means interrupts a power feed to the electromagnetic solenoid at a high seed by means of the third switching element immediately after, the valve-opening signal has ended. In the mentioned conduction control, minimum value of an output voltage from the auxiliary power supply is set to be larger than a maximum value of voltage of the main power supply, and a step-up operation of the auxiliary power supply is stopped during the rapid power feed.

As a result of above arrangement, energy for the rapid power feed at the time of opening the valve does not come under the influence of a voltage variation in on-vehicle battery acting as the main power supply. Thus, a valve-opening operation can be performed stably, and the auxiliary power supply can be prevented from over-load. Furthermore, the step-up of voltage is started immediately after the rapid power feed to be capable of obtaining a stable high voltage, thereby enabling to achieve a smaller-sized auxiliary power supply at a reasonable cost. Besides, it is possible to set the power feed reliably in three stages of rapid power feed, continuous power feed and holding power feed, as well as the switching elements can be shared or commonly used in performing control of the continuous power feed and holding power feed. Consequently, it can be achieved easily to limit a current value of the holding power fed to the minimum holding current to suppress temperature rise in the electromagnetic solenoid, and reduce number of parts as well.

BRIEF DESCRIPTION OF THE DRAWINGS

FIG. 1 is a circuit diagram for explaining a control device of a fuel injection valve according to a first preferred embodiment of the present invention.

FIG. 2 is a characteristic chart for explaining operation of the control device of a fuel injection valve according to the first embodiment of the invention.

FIG. 3 is a flowchart for explaining operation of the control device of a fuel injection valve according to the first embodiment of the invention.

FIG. 4 is a circuit diagram for explaining a control device of a fuel injection valve according to a second preferred embodiment of the invention.

FIG. 5 is a circuit diagram for explaining the control device of a fuel injection valve according to the second embodiment of the invention.

FIG. 6 is a flowchart for explaining operation of the control device of a fuel injection valve according to the second embodiment of the invention.

FIG. 7 is a general circuit diagram for explaining a control device of a fuel injection valve according to a third preferred embodiment of the invention.

FIG. 8 is a circuit diagram of an error detection circuit arranged in the control device of a fuel injection valve according to the third embodiment of the invention.

FIG. 9 is a general circuit diagram for explaining a control device of a fuel injection valve according to a fourth preferred embodiment of the invention.

FIG. 10 is a circuit diagram of an error detection circuit arranged in the control device of a fuel injection valve according to the fourth embodiment of the invention.

DESCRIPTION OF THE PREFERRED EMBODIMENTS

Embodiment 1.

FIGS. 1 through 3 are to explain a control device of a fuel injection valve according to a first preferred embodiment of the present invention. FIG. 1 is a circuit diagram for explaining constitution, FIG. 2 is a characteristic chart for explaining operation and FIG. 3 is a flowchart for explaining operation. Referring to these drawings, an electric power is supplied from a main power supply 1 to a fuel injection valve and a control device via a key switch 2. The main power supply 1 is, for example, an on-vehicle battery of 12V of which an actual voltage varies within the range of approximately 10V, being the minimum value, to approximately 16V, being the maximum value.

An electric power from the main power supply 1 is supplied to a constant voltage power supply 3, where the power is converted into a stable constant voltage of, e.g., DC5V and supplied to a CPU4*a*. The CPU4*a* is provided with a nonvolatile memory NEM such as flash memory or a RAM for operation processing, and operates control conditions in response to information inputs from a sensor group 5 that detects an operation state of an internal combustion engine. The sensor group 5 is constituted of a large number of ON/OFF sensors or analog sensors including a rotation sensor, crank angle sensor, airflow sensor, cylinder pressure sensor, air-fuel ratio sensor and water temperature sensor. Outputs from these sensors are inputted to the CPU4*a* via an input interface or AD converter, not shown.

The CPU4*a* according to this first embodiment possesses a function to control a fuel injection. This function is provided by valve opening signal generation means for outputting a valve-opening signal PL1 and a valve opening drive signal PL2. As shown in and described later referring to characteristics (a) and (b) of FIG. 2, the function provided by the valve opening signal generation means is on the basis of an information input from various sensors forming the sensor group 5 and a program stored in the nonvolatile memory MEM. The valve-opening signal PL1 is in correspondence to an engine speed of the internal combustion engine and a fuel amount to be supplied, and a logic level thereof is H throughout the whole time period from the valve-opening time to the valve-closing time. The valve-opening drive signal PL2 is the one of which logic level is H during a predetermined time period Tk after the valve-opening signal PL1 has become to H level. The valve-opening drive signal PL2 is kept at H level for a total time period of a rapid power feed time period and a continuous power feed time period.

An auxiliary power supply 6 enclosed within dot lines in FIG. 1 is an auxiliary power supply for applying a high voltage. This auxiliary power supply 6 consists of an induction element 7, a diode 8, a capacitor 9 for high voltage, an exciting switching element 10, a current detection resistor 11, a gate circuit 12, a drive resistor 13 and a determination circuit 14. In this auxiliary power supply 6, an electric power is fed from the main power supply 1 to the induction element 7 via the exciting switching element 10 and the current detection resistor 11. Then, an electromagnetic energy having been charged at the induction element 7 is discharged to the capacitor 9 via the diode 8 owing to an open circuit of the exciting switching element 10, and a high voltage is charged into the capacitor 9.

Output from an inversion logic element 15 for inputting the above-mentioned valve-opening signal PL2 is inputted to the gate circuit 12. When the valve-opening signal PL2 is at H level, that is, during the rapid power feed time period and continuous power feed time period, a logic output from the inversion logic element 15 becomes at L level. This L level logic output is inputted to the gate circuit 12, resulting in prohibition of conduction to the exciting switching element 10. Further, when voltage across both terminals of the current detection resistor 11 is not more than a predetermined value, the determination circuit 14 outputs a conduction command to bring the exciting switching element 10 into a state of conduction via the gate circuit 12 and the drive resistor 13. At the same time, the determination circuit 14 discontinues the conduction command to stop driving the exciting switching element 10 for a predetermined time period after the voltage across the current detection resistor 11 has become not less than a predetermined value. During this stop time period, the capacitor 9 is charged with power. Thus, the capacitor 9 is charged with power by repeating ON/OFF of the exciting switching element 10. When a charging voltage has reached a predetermined value Vpmax, the determination circuit 14 detects this state to stop the conduction command, and stops charging the capacitor 9.

The valve-opening signal PL1 and valve-opening drive signal PL2 of the CPU4 are sent to a logic circuit 16 that controls power feed. Then, the logic circuit 16 outputs three control signals, being a control signal A, control signal B and control signal C based on these signals PL1 and PL2. The control signal A is sent to a first switching element 20 via a base resistor 17, a drive transistor 18 and a drive resistor 19. The control signal B is sent to a second switching element 24 via a base resistor 21, a drive transistor 22 and a drive resistor 23. The control signal C is sent to a third switching element 26 via a drive resistor 25. The first switching element 20, second switching element 24 and third switching element 26 are constituted of a bipolar-type or field effect-type power transistors. The third switching element 26 has an interruption voltage limiting function (withstanding voltage limiting characteristic) which voltage is larger than the maximum output voltage from the auxiliary power supply 6. Furthermore, in this embodiment, the logic circuit 16 is provided with function as conduction control means for controlling current flowing through each switching element.

The first switching element 20 supplies a charging voltage of the capacitor 9 to an electromagnetic solenoid 27, and the control signal A comes to a high level because voltage of the capacitor 9 is high. At the same time, an electric power is rapidly fed to the electromagnetic solenoid 27. The second switching element 24 is connected to the electromagnetic solenoid 27 via a back-flow prevention diode 28. Electric power continues to be fed from the main power supply 1 to the electromagnetic solenoid 27 while the control signal B is being at a high level. The third switching element 26 is the one that performs an interruption control of current flowing through the electromagnetic solenoid 27, and enables conduction to the electromagnetic solenoid 27 while the control signal C is being at a high level. Current to the electromagnetic solenoid 27 is conducted via the third switching element 26 and current detection resistor 26. A communicating diode 30 is connected in parallel to the electromagnetic solenoid 27, the third switching element 26 and the current detection resistor 29.

A terminal voltage at the current detection resistor 29 is supplied to the logic circuit 16 via an amplifier 31 and an AD converter 32, and these elements form current detection means. The logic circuit 16 outputs each of the above-mentioned control signals, as well as outputs an error signal ER to the CPU4*a*. The CPU4*a* outputs a signal based on this error signal ER to an alarm display 33. In addition, each of the control signals A, B, C, which the mentioned logic circuit 16 outputs, are shown as characteristics (e)–(g) in FIG. 2.

State of various signals and power conduction is as shown in a characteristic chart of FIG. 2. The valve-opening signal PL1 is at H level during a valve-opening drive time period (rapid power feed time period+continuous power feed time period) and an open-valve hold time period. The valve opening drive signal PL2 is at H level during a valve-opening drive time period (rapid power feed time period+ continuous power feed time period). The control signal A is at a H logic level during a first half time period of the valve-opening drive signal PL2 and, during this time period, the first switching element 20 is brought into conduction and the rapid power feed is performed. As a result, as shown in the characteristic (c), an excitation current to the electromagnetic solenoid 27 builds up and reaches a peak value Ia. A logic level of the control signal A returns to L by peak current detection means consisting of the current detection resistor 29 and logic circuit 16, thus the rapid power feed is stopped. The peak current detection means is preferably constituted of comparison means for comparing, for example, an excitation current to the electromagnetic solenoid 27 with a first threshold (i.e., a predetermined peak current value Ia).

Furthermore, as shown in the characteristic (f) of FIG. 2, the control signal B changes to H logic level during the whole time period while the valve-opening drive signal PL2 is being at H level, and the continuous power feed is performed. In addition, logic level of the control signal B changes repeatedly during the open-valve hold time period of the valve-opening signal PL1, and control of the open-valve holding current is performed. A logic level of the control signal A comes to L during the continuous power feed time period of the valve-opening drive signal PL2, whereby the first switching element 20 is brought into an OFF state. The second switching element 24, however, continues to be conductive in response to the control signal B. Accordingly, as shown in the characteristic (c) of FIG. 2, the excitation current to the electromagnetic solenoid 27 begins attenuation from the peak value Ia. This current attenuates to Ib at the end of the continuous power feed time period.

Change of the control signal B for a second half time period of the valve-opening signal PL1, that is an open-valve hold time period, is as shown in the characteristic (c). That is, when the excitation current to the electromagnetic solenoid 27 is above a target upper limit Id in feedback control, the control signal B comes to a logic level L. On the other hand, the control signal B comes to a logic level H when an excitation current to the electromagnetic solenoid 27 is below a target lower limit Ie in feedback control. Further, as shown in a characteristic (g) of FIG. 2, the control signal C comes to a logic level L for a period of time immediately after the valve-opening drive signal PL2 has changed from the logic level H to L and when the valve-opening signal PL1 is at a logic level L.

Immediately after the valve-opening drive signal PL2 has changed from a logic level H to L, during attenuation of the excitation current-from a final value Ib of the continuous feed to an attenuation determination current Ic as shown in the characteristic (c) to the electromagnetic solenoid 27, this excitation current is not conducted to the second switching element 24 and the third switching element 26. In particular, the excitation current is in the state of non-conduction to the third switching element 26 capable of performing a high-speed interruption, whereby the excitation current to the electromagnetic solenoid 27 attenuates rapidly resulting in suppression of temperature rise in the electromagnetic solenoid 27. In addition, respective current values in the characteristic (c) are in relation as expressed in the following inequality:

A peak value Ia of excitation current>a continuous feed final current value Ib>an attenuation determination current value Ic>a target lower limit Ie of feedback control current.

After the valve-opening signal PL1 has changed from logic level H to L, the excitation current to the electromagnetic solenoid 27 becomes interrupted from the second switching element 24 and the third switching element 26. In particular, interruption at the third switching element 26 causes the excitation current to the electromagnetic solenoid 27 to be rapidly attenuated, thus brings a fuel injection valve into a rapid valve-closing operation. It is certain that there may be a case where a time period of holding an open valve, shown in FIG. 2(*a*), is extremely short depending on operating conditions of the internal combustion engine. Even in such a case, a high-speed interruption by means of the third switching element 26 immediately after the valve-opening drive signal PL2 has changed from logic level H to L contributes to performance of the rapid valve-closing operation. The characteristic (h) of FIG. 2 shows waveforms of a surge voltage generated at both terminals across the third switching element 26 when the third switching element 26 is interrupted. The maximum value of this surge voltage is determined depending on interruption voltage limiting characteristic of the third switching element 26.

A characteristic (d) of FIG. 2 shows a voltage characteristic of the auxiliary power supply 6. During the rapid power feed time period when a control signal A is at H level and the first switching element 20 is in the state of ON, the capacitor 9 is prohibited from being charged with power by means of the gate circuit 12. In the meantime, electric charge of the capacitor 9 is discharged to the electromagnetic solenoid 27 via the first switching element 20. Therefore, the output voltage of the auxiliary power supply 6 attenuates from the maximum voltage Vpmax at the end of charge to the minimum voltage vpmin at the end of discharge. When the control signal A comes to L level as well as the first switching element 20 is OFF, discharge from the capacitor 9 is stopped. However, charge is not started and the voltage vpmin is maintained. When the valve-opening drive signal PL2 comes to L level and the continuous power feed time period ends, ON/OFF operation of the exciting switching element 10 of the auxiliary power supply 6 is started, and the capacitor 9 is gradually charged by degrees resulting in voltage step-up. Then, when finally voltage has reached the maximum voltage Vpmax, operation of the exciting switching element 10 is stopped, and the capacitor 9 is ready for the next electric discharge.

Additionally, the minimum voltage vpmin of the auxiliary power supply 6 is set so as to be a value larger than the maximum voltage Vbmax of the main power supply 1. Since all the power feed energy in order to perform the valve-opening drive of the electromagnetic solenoid 27 is supplied from a part of the electric charge having been stored in the capacitor 9 of the auxiliary power supply 6, energy is not supplied to the electromagnetic solenoid 27 from the main power supply during such supply time period. Thus, energy sharing is established. Further, immediately after the valve-opening drive time period, being a sum of the rapid power feed time period and the continuous power feed time period, has passed, charging the capacitor 9 with power is started, whereby a predetermined voltage Vpmax is reliably secured by the next rapid power feed.

The output voltage of the main power supply 1, as described above, varies from the minimum value of approximately 10V (Vbmin) to the maximum value of approximately 16V (Vbmax). Specifications of the electromagnetic solenoid 27 is set to be capable of performing the valve-opening drive of the fuel injection valve even when the voltage is the minimum value Vbmin. Thus, an open-valve holding voltage Vh=Ih×R (where: R denotes a wire wound resistance of the electromagnetic solenoid 27) corresponding to an open-valve holding current Ih=(Id+Ie)/2 in the characteristic (c) of FIG. 2, becomes a small value. Accordingly, when voltage of the main power supply 1 is the maximum value Vbmax, ratio between Vbmax and Vh becomes significantly larger.

As described above, to stably obtain a small open-valve hold voltage Vh in a high power supply voltage state (Vbmax), the communicating diode 30, which is provided so that the excitation current to the electromagnetic solenoid 27 may attenuate slowly when the second switching element 24 is OFF, plays an important role. In addition, an ON/OFF cycle of the second switching element 24 is set to be a sufficiently short time period as compared with an induction time constant (rate between inductance and wire wound resistor) of the electromagnetic solenoid 27.

As for relation between a value of an average voltage of the auxiliary power supply 6 Vpa=(Vpmax+Vpmin)/2, a value of an open-valve hold voltage Vh=Ih=R×(Id+Ie) and a value of an output voltage Vbmin to Vbmax of the main power supply 1, ideally (Vpa/Vbmax)≈(Vbmin/Vh) is to be a target specification. However, it is desirable to maintain at least the relation expressed by the following inequalities.

$$(Vb\max/Vh)^2>(Vpa/Vh)>(Vb\min/Vh)^2 \quad (1)$$

The relation expressed by the inequality (1) is induced from the following inequalities.

$$Vpa/Vb\min>Vb\min/Vh \quad (2)$$

$$Vpa/Vb\max<Vb\max/Vh \quad (3)$$

The following inequalities (4) and (5) are obtained by transforming the inequalities (2) and (3).

$$Vpa\times Vh>Vb\min 2 \quad (4)$$

$$Vpa\times Vh>Vb\max 2 \quad (5)$$

The inequality (1) is obtained by summing up the inequalities (4) and (5) and dividing each side by Vh2.

In the case where internal and external diameter is identical to width dimension in the electromagnetic solenoid 27, magnetomotive force (current×number of turns) is proportional to the square root of a power consumption W allowed for the electromagnetic solenoid 27 to consume. In the case where dimension, magnetomotive force and power consumption are set to be constant, a required excitation voltage becomes lower by making diameter of wire larger to achieve a design of low resistance and large current. On the contrary, a required excitation voltage becomes higher by making diameter of wire smaller to achieve a design of high resistance and small current. Accordingly, an open-valve hold voltage Vh of the electromagnetic solenoid 27 can be designed to be smaller in any way, and sufficiently powered rapid power feed can be carried out even if an output voltage from the auxiliary power supply 6 is small. In such a design, however, excitation current to the electromagnetic solenoid 27 comes to be excessively large, and power consumption of respective switching elements increases.

On the other hand, in the case where an open-valve hold voltage Vh of the electromagnetic solenoid 27 is designed to be larger, an excitation current to the electromagnetic solenoid 27 becomes smaller, resulting in decrease in power consumption of respective switching elements. However, to perform a sufficiently powered rapid feed, an output voltage from the auxiliary power supply 6 comes to be excessively large. Moreover, when stopping operation of the auxiliary power supply 6, the valve-opening drive of the electromagnetic solenoid 27 cannot be performed by means of the main power supply 1. To maintain relation expressed by the above-mentioned inequality (2), a value of an open-valve hold voltage Vh on the right side should not be excessively small in the case where a value on the left side is an upper limit. Consequently, a condition of restricting excessively large excitation current to the electromagnetic solenoid 27 is established. Furthermore, to maintain relation expressed by the above-mentioned inequality (3), supposing that a value on the right side is an upper limit, an output voltage Vpa from the auxiliary power supply 6 on the left side should not be excessively large. Consequently, a condition of restricting an excessively large maximum voltage, which is applied to respective switching elements and the electromagnetic solenoid 27, is established.

Now operation of the control device of a fuel injection valve according to this first embodiment of the invention arranged as described above is hereinafter described with reference to FIGS. 2 and 3. Referring to the drawings, the CPU4*a* starts operation in response to ON of the key switch 2, and outputs a valve-opening signal PL1 and valve-opening drive signal PL2 shown in (a) and (b) of FIG. 2. In response to these signals, the logic circuit 16 comes to operate and outputs a control signal A, control signal B and control signal C shown in (e)–(g) of FIG. 2. Conduction with respect to the first switching element 20, the second switching element 24 and the third switching element 26, shown in FIG. 1, is controlled. Further, the capacitor 9 of the auxiliary power supply 6 is charged up to a predetermined voltage while the valve-opening drive signal PL2 is at logic level L. Although this charging to the capacitor 9 is stopped upon commencing the rapid power feed, start-up of the rapid power feed is detected by the fact that the valve opening drive signal PL2 is sent to the inversion logic element 15. Accordingly, in this first embodiment, an inversion logic element 15 acts as the rapid power feed detection means.

When the valve-opening drive signal PL2 comes to logic level H, the control signal A comes to logic level H as well. Then ON of the first switching element 20 starts the rapid power feed to the electromagnetic solenoid 27, and a valve-opening operation of the fuel injection valve is started during this rapid power feed time period. During the time period when the first switching element 20 is OFF and the second switching element 24 is ON, a logic level of the control signal B is continuously "H", and a continuous power feed to the electromagnetic solenoid 27 is performed. During the continuous power feed time period, an open valve state of the fuel injection valve is maintained.

During the subsequent open-valve hold time period, a logic level of the control signal B varies alternately between H and L, the second switching element 24 performs an ON/OFF operation, and an open-valve holding current is supplied to the electromagnetic solenoid 27. This open-valve holding current is set a current value as small as possible but not less than the minimum current value enabling the electromagnetic solenoid 27 to hold valve open. Conduction to the third switching element 26 is controlled in response to the control signal C. The third switching element 26 is arranged so as to rapidly attenuate an excessive transient-decay current during the open-valve holding time period, or reduce a valve-closing operation delay due to a gradual transient-decay current to perform a, rapid valve-closing operation.

Logic operation and equivalent operation of the logic circuit 16 are hereinafter described with reference to FIG. 3. In step 300, a periodically activated operation is started. Instep 301, it is determined whether or not both valve-opening signal PL1 and valve-opening drive signal PL2 have changed from logic level L to H. When the valve-opening signals PL1 and PL2 are at H level, the program proceeds to step 302, in which it is determined whether or not the valve opening drive signal PL2 has changed from logic level H to L. At this time, if the valve opening drive signal PL2 has not changed to L level, the program proceeds to step 303. In step 303, a control signal A is changed to H level, a control signal B is changed to H level, and a control signal C is changed to H level. In this step 303, the first switching element 20 and third switching element 26 are ON, and the rapid power feed is performed to the electromagnetic solenoid 27. Although the second switching element 24 is also ON in response to the control signal B in this step 303, an electric power is not fed from the main power supply since a high voltage is applied from the first switching element 20 to the electromagnetic solenoid 27.

In the subsequent step 304, it is determined whether or not the excitation current flowing to the electromagnetic solenoid 27 has reached a predetermined peak current Ia (compared with the mentioned first threshold). When this excitation current has reached a predetermined peak current Ia, the program proceeds to step 305, in which a logic level of the control signal A is changed from H to L, and the control signal B and control signal C continue to be at a H level. Accordingly, the first switching element 20 comes to be in a state of OFF, and the second switching element 24 and third switching element 26 are maintained in the state of ON. Thus, the current flowing through the electromagnetic solenoid 27 is switched to be in a mode of continuous power feed from the main power supply 1.

In addition, in the case where the excitation current has not reached the peak current Ia in step 304, the program returns to step 302 to repeat steps up to step 304, and waits for the excitation current reaching the peak value. However, in the case where determination in step 302 is YES (the valve-opening drive signal PL2 returns to logic level L) before determination in step 304 becomes YES due to insufficient output voltage from the auxiliary power supply 6 or failure in which the first switching element 20 cannot be turned ON, the program proceeds to step 306, where an error signal output ER is set.

Each control signal is set in step 305, and thereafter the program proceeds to step 307, in which it is determined whether or not the valve-opening drive signal PL2 has changed from logic level H to L. When determination in step 307 is NO, the program returns to step 305 to repeat the step 305 and step 307. In the case where the determination in step 307 is YES as well as after the error signal has been outputted in step 306, the program proceeds to step 308. In this step 308, the control signal A is maintained at L, and the control signals B and C are changed from H to L. Accordingly, the first switching element 20 continues to be OFF, and the second switching element 24 and the third switching element 26 come to be OFF so that the excitation current to the electromagnetic solenoid 27 is interrupted at a high speed. In the subsequent step 309, it is determined whether or not an excitation current I to the electromagnetic solenoid 27 has comes to be not more than an attenuation determination current Ic. When the determination herein is NO, the program returns to step 308 to repeat the step 308 and step 309.

When determination in step 309 is YES, the program proceeds to step 310, in which it is determined whether or not a logic level of the valve-opening signal PL1 has changed from H to L. In the case where PL1 is not changed and continues to be at H level herein, the control signal C is returned to H level again in step 311, and the program proceeds to step 312. In this step 312, it is determined whether or not the excitation current I to the electromagnetic solenoid 27 has decreased to be not more than a lower limit Ie of a feedback control. If decreased, the program proceeds to step 313, in which the control signal A is maintained at L, and the control signal B is changed from L to H. Thus, in this step 313, the first switching element 20 continues to be OFF, the second switching element 24 is ON. Since the third switching element 26 has been ON in step 311, an open-valve holding power feed to the electromagnetic solenoid 27 is started to bring the excitation current to be not less than the lower limit Ie. That is, Ie is a second threshold current, and when the excitation current I to the electromagnetic solenoid 27 comes below Ie, for example, second comparison means detects this state to bring the second switching element 24 to ON.

After the operation in step 313, as well as when the excitation current I is not less than the lower limit Ie in step 312, the program proceeds to step 314. In this step 314, it is determined whether or not the excitation current I to the electromagnetic solenoid 27 is not less than the upper limit Id of the feedback control. When the excitation current I is not less than Id, the program proceeds to step 315, in which the control signal A is maintained at L, the control signal B is changed from H to L, and the control signal C is kept at H. Accordingly, in step 315, the first switching element 20 is maintained at OFF, the second switching element 24 is changed to OFF, and the third switching element 26 continues to be ON to bring the excitation current to the electromagnetic solenoid 27 in gradual attenuation.

In the case where the excitation current I is not less than Id in step 314, and after the operation of step 315 has completed, the program returns to step 310. While the determination in step 310 is being NO, the program repeats operations of steps 310 to 315, and the excitation current to the electromagnetic solenoid 27 is controlled so as to be in a range of Ie–Id. Further step 316 enclosed within the dot lines, is a block consisting of the steps 312 to 315. This block serves as the holding current control means for controlling an open-valve holding current so as to be in the range of Ie to Id. In addition, Ie is set to be a value rather larger than the minimum current value required for holding the electromagnetic solenoid 27 to be valve open, and Id is set to be a value larger than Ie by a predetermined value.

When PL1 and PL2 are at a L level in the first step 301, as well as in the case where PL1 has changed to L in step 310, the program proceeds to step 317, in which all the control signals A–C are set to L level. Accordingly, in step 317, all the first switching element 20, second switching element 24 and third switching element 26 are OFF to be in a state that the power feed to the electromagnetic solenoid 27 is stopped. In the subsequent step 318, it is determined whether or not a predetermined time period has passed by monitoring operation of a power supply timer, not shown, that generates a time-up output after a predetermined time period has passed from the moment of turning on the key switch 2. This predetermined time period is set to a time period necessary for voltage of the capacitor 9 in the auxiliary power supply 6 to be charged from 0 up to the maximum voltage Vpmax, e.g., when voltage of the main power supply 1 is the minimum value Vbmin.

In the case where it is determined in step 318 that a predetermined time period has passed, the program proceeds to step 319. In this step 319, it is determined whether or not an output voltage from the auxiliary power supply 6 is, for example, not less than a predetermined minimum voltage Vpmin. Monitoring output from a comparison circuit, not shown, connected to the logic circuit 16 performs this determination. In the case where an output voltage from the auxiliary power supply 6 has not reached the predetermined voltage, the program proceeds to step 320, in which an error signal output ER is set. When the output voltage from the auxiliary power supply 6 has reached a predetermined voltage, when the determination is NO in step 318, and after the error signal has been set in step 320, then the program proceeds to step 321 being a final step. The logic circuit 16 performs standby for implementing other control, and returns to step 300 being the operation start step.

In the case where the error signal output ER is set in step 306 or step 320, the CPU4*a* makes a generation time of a valve-opening signal PL1 earlier or makes an end time of a valve-opening drive signal PL2 later. Thus, a generation time period of the valve-opening drive signal PL2 is extended and starts operation of the alarm display 33. As a result, even in the case of occurring an error in the auxiliary power supply 6 thereby no sufficient output voltage being obtained, current from the main power supply 1 is fed from the second switching element 24 to the electromagnetic solenoid 27 via the back-flow prevention diode 28. Therefore, even when occurring any response delay, valve-opening operation of the fuel injection valve is performed and, consequently, evacuation operation is carried out. Thus, the step 319 functions as auxiliary power supply error detection means, and the step 320 functions as auxiliary power supply error-processing means, thereby enabling the operation to be continued.

Additionally, in the case where an error signal output ER is generated instep 306 or step 320, not only a valve-opening drive time period is extended, but also a value of a peak current Ia is set to be rather low. In the case where the error signal output ER is still generated in step 306 in spite of taking such procedures, a power feed stop signal is generated, whereby a power feed to the electromagnetic solenoid 27 can be stopped.

In the control device of a fuel injection valve according to the first embodiment of the invention arranged as described above, the auxiliary power supply 6 can supply a stable valve-opening voltage to the electromagnetic solenoid 27 without being influenced by any voltage variation in the main power supply 1. Further, step-up of voltage is stopped during the power feed from the auxiliary power supply 6 to prevent the auxiliary power supply 6 from over-load. In addition, stopping the step-up of voltage during the continuous power feed causes voltage of the auxiliary power supply 6 to decrease at the time of the short circuit of the first switching element 20, thereby preventing the third switching element 26 from being damaged. Furthermore, the holding current or applied voltage during the open-valve holding time period is controlled to be in a predetermined range by the feedback control. Thus, it becomes possible to prevent the electromagnetic solenoid 27 or switching element from any temperature rise or excessively large electrical stress, and it becomes further possible to carry out an evacuation operation also against error in the auxiliary power supply 6 and each switching element Further, in this first embodiment, the first switching element 20 and second switching element 24 are in a parallel relation, and therefore it is also possible to suppress temperature change in the electromagnetic solenoid 27 by performing a selective conduction to both switching elements.

Furthermore, when the second switching element 24 is turned ON/OFF in order to perform the holding current control, an induction current of the electromagnetic solenoid 27 reflows to the communicating diode 30 to make the current change slow, thereby enabling stable control of the holding current. Thus, the exciting switching element 10 of the auxiliary power supply 6 is turned OFF during the rapid power feed to the electromagnetic solenoid 27. As a result, the capacitor 9 is not maintained at a high voltage, but decreases as electric discharge proceeds, thereby enabling to suppress temperature rise in the electromagnetic solenoid 27 and prevent the first and third switching elements from being damaged. Additionally, the rapid power feed is stopped due to the fact that an excitation current flowing to the electromagnetic solenoid 27 has reached the predetermined peak current Ia to proceed to the mode of continuous power feed. Therefore, temperature rise in the electromagnetic solenoid 27 is suppressed. Further, since the third switching element is temporarily brought into OFF after the continuous power feed has ended, the excitation current quickly decreases making it possible to close the valve at a high speed.

Embodiment 2.

FIGS. 4 through 6 are to explain a control device of a fuel injection valve according to a second preferred embodiment of the invention. FIG. 4 is a circuit diagram for explaining constitution, FIG. 5 is a characteristic chart for explaining operation, and FIG. 6 is a flowchart for explaining the operation. Constitution and operation are hereinafter described focusing on differences from those in the foregoing first embodiment.

A CPU4*a* according to this second embodiment outputs a valve-opening signal PL1 such as shown in characteristic (a) of FIG. 5 on the basis of information inputted from various sensors forming a sensor group 5 and on programs stored in a nonvolatile memory MEM. Further, a logic circuit 16*b* outputs a valve-opening drive signal PL2 shown in characteristic (b) of FIG. 5, and a control signal A, control signal B and control signal C shown in characteristics (e) to (g) of FIG. 5. Accordingly, PL1 is outputted from the CPU4*b* functioning as valve-opening signal generation means, and each control signal and PL2 are outputted from the logic circuit 16*b* functioning as control means.

A terminal voltage at the current detection resistor 29, which detects a current flowing through the third switching element 26 for controlling a current flowing through the electromagnetic solenoid 27, is inputted to the logic circuit 16 via an amplifier circuit 34. This amplifier circuit 34 consists of a first comparison amplifier 35*a* and second comparison amplifier 35*b*, input resistors 36*a* and 36*b*, threshold voltage signal generation means 37*a* and 37*b*, and positive feedback resistors 38*a* and 38*b*. The input resistors 36*a* and 36*b* apply a terminal voltage of the current detection resistor 29, which detects the current flowing through the electromagnetic solenoid 27, to a positive-side input terminal of the first comparison amplifier 35*a* and second comparison amplifier 35*b*. Outputs from both comparison amplifiers 35*a* and 35*b* are inputted to a logic circuit 16*b*. The current detection resistor 29 and both comparison amplifiers 35*a* and 35*b* form current detection means.

A threshold value of the threshold voltage signal generation means 37*a* is set to be a threshold voltage corresponding to a terminal voltage at the current detection resistor 29 when the peak current Ia shown in the characteristic (c) of FIG. 5 flows through the current detection resistor 29. It is arranged such that an output from the comparison amplifier 35*a* comes to a logic level H and inputted to the logic circuit 16*b* when an excitation current to the electromagnetic solenoid 27 is not less than the predetermined peak current Ia. That is, this threshold value corresponds to the first threshold value described in the foregoing first embodiment. In addition, once output level of the first comparison amplifier 35*a* has reached a logic level H, the first comparison amplifier 35*a* is set to be logic level H until an excitation current to the electromagnetic solenoid 27 becomes not more than an attenuation determination current Ic shown in the characteristic (c) of FIG. 5 by the action of a positive feedback resistor 38*a*.

Further, a threshold value of the threshold voltage signal generation means 37*b* is set to a threshold voltage corresponding to the voltage across the current detection resistor 29 when conducting an upper limit current Id shown in the characteristic (c) of FIG. 5. It is arranged such that an output from the second comparison amplifier 35*b* comes to logic level H and inputted to the logic circuit 16*b* when an excitation current to the electromagnetic solenoid 27 comes up to not less than an upper limit current Id. In addition, once the output from the second comparison amplifier 35*b* has come to logic level H, the second comparison amplifier 35*b* is set to be maintained at logic level H until the excitation current to the electromagnetic solenoid 27 becomes not more than a lower limit current Ie shown in the characteristic (c) of FIG. 5 by the action of a positive feedback resistor 38*b*.

An inversion logic element 15*b* inputs a control signal A to output an inversion signal. This inversion signal is inputted to the gate circuit 12 of the auxiliary power supply 6. When the first switching element 20 is in conduction and a rapid power feed takes place, output from the inversion logic element 15*b* comes to logic level L, and consequently the exciting switching element 10 is brought into interruption via the gate element circuit 12. Further, in this,second embodiment, it is arranged such that the second switching element 24 is connected from the key switch 2 via a back-flow prevention diode 40, and the first switching element 20 and second switching element 24 are connected in series. It is further arranged such that the rapid power feed from the auxiliary power supply 6 is supplied to the electromagnetic solenoid 27 via the first switching element 20 and second switching element 24.

Thus, when the rapid power feed is performed to the electromagnetic solenoid 27, all the first switching element 20, second switching element 24 and third switching element 26 are brought into conduction. Further, the first switching element 20 is brought into OFF under this state, thereby leading to a continuous power feed state. It is certain that a characteristic chart of FIG. 5 is substantially the same as that of FIG. 2. But note that the valve-opening drive signal PL2 of FIG. 5(*b*) is generated by means of the logic circuit 16*b* instead of the CPU4*a*, and further charge/discharge characteristics of the auxiliary power supply 6 of FIG. 5(*d*) is different from those in FIG. 2. In FIG. 5(*d*), step-up operation of the auxiliary power supply 6 is stopped, and discharge to the electromagnetic solenoid 27 is performed only during the rapid power feed time period in which the first switching element is ON. The step-up operation of the auxiliary power supply 6 is arranged so as to start immediately after the rapid power feed time period has ended and the control signal A has come to logic level L.

A difference between the power feed circuit of FIG. 1 shown in the foregoing first embodiment and the power feed circuit of FIG. 4 according to this second embodiment is as follows. That is, in the foregoing first embodiment shown in FIG. 1, the second switching element 24 and the first switching element 20 are connected in parallel. On the other hand, in this second preferred embodiment shown in FIG. 4, the second switching element 24 and the first switching element 20 are connected in series Accordingly, in the arrangement of FIG. 1, occurrence of any short circuit failure at the first switching element 20 causes the third switching element 26 to be an open circuit eventually preventing the electromagnetic solenoid 27 from burnout. On the other hand, in the arrangement of FIG. 4, when any short circuit failure occurs at the first switching element 20, the current flowing through the electromagnetic solenoid 27 can be interrupted either by the second switching element 24 or by the third switching element 26.

Now, operation of the control device of a fuel injection valve according to the second embodiment arranged as described above is hereinafter described with reference to FIGS. 5 and 6. Referring to the figures, ON of the key switch 2 causes the CPU4*b* to start operation and output the valve-opening signal PL1 shown in FIG. 5(*a*). This signal brings the logic circuit 16*b* into operation, whereby the valve-opening drive signal PL2 and the control signal A, control signal B and control signal C, shown in FIGS. 5(*b*) and FIGS. 5(*e*) to (*g*), are generated. Further, conduction to the first switching element 20, second switching element 24 and third switching element 26, shown in FIG. 4, are controlled. Furthermore, the first switching element 20 is in an open circuit while a logic level of the control signal A comes to L, and the capacitor 9 of the auxiliary power supply 6 is charged up to a predetermined voltage during this time period.

The first switching element 20 performs a rapid power feed to the electromagnetic solenoid 27 in cooperation with the second switching element 24. During this rapid power feed time period, the control signal A and control signal B are at a logic level "H", and these H-level signals cause a valve-opening operation of the fuel injection valve to start. Further, while the first switching element 20 is OFF and the second switching element 24 is ON, the logic level of the control signal A is L, and the control signal B continues to be at a logic level H. Thus, a continuous power feed is performed to the electromagnetic solenoid 27. During this continuous power feed time period, operation of the moving section of the fuel injection valve is terminated and settled.

Then, in the same manner as in the foregoing first embodiment, logic level of the control signal B changes alternately between H and L, and the second switching element 24 performs ON/OFF operations, whereby an open-valve holding current is supplied to the electromagnetic solenoid 27. This open-valve holding current is set to be a current value as small as possible in a range of not less than the minimum current enabling the electromagnetic solenoid 27 to hold an open-valve state. The third switching element 26 is controlled by conduction to the control signal C, and rapidly attenuates an excessive transient-decay current during the open-valve hold time period, or reduces a valve-closing operation delay due to gradual transient-decay current to perform a rapid valve-closing operation.

A logic operation and equivalent operation of the logic circuit 16*b* are described as follows with reference to FIG. 6. In step 600, a periodically activated operation is started. In step 601, it is determined whether or not the valve-opening signal PL1 has changed from logic level L to logic level H. When the valve-opening signal PL1 has changed to H, the program proceeds to step 602, in which a timer Tk, which determines a valve-opening drive time period, is activated. In the subsequent step 603, it is determined whether or not the time of the timer Tk having been activated in step 602 is up. When the time of the timer Tk is not up, the program proceeds to step 604, in which the control signal A, control signal B and control signal C are set to a logic level H. Accordingly, all the first switching element 20, second switching element 24 and third switching element 26 are brought into ON and, as a result, the rapid power feed to the electromagnetic solenoid 27 is started.

In the subsequent step 605, it is determined whether or not the excitation current I to the electromagnetic solenoid 27 has reached the predetermined peak current Ia by monitoring whether or not an output from the first comparison amplifier 35a is at a logic level H. When this excitation current has reached the predetermined peak current Ia, the program proceeds to step 606, in which the control signal A is set from H to L, and the control signal B and control signal C continue to be at H level. Accordingly, in this step 606, the first switching element 20 is OFF, the second switching element 24 and third switching element 26 continue to be ON, and the continuous power feed to the electromagnetic solenoid 27 is performed.

In the case where the excitation current I has not reached a predetermined peak current Ia in step 605, the program returns from step 605 to step 603 and waits for the excitation current reaching the predetermined peak current value Ia while repeating routine between the foregoing steps 603 to 605. However, in the case of occurring any insufficient output voltage of the auxiliary power supply 6 or such abnormality that the first switching element 20 may not be ON, the determination by step 650 continues to be NO. Therefore, step 603 implements determination whether or not the time is up, and the program proceeds to step 607, in which an error signal output ER is set.

Step 608 following step 606 is a step in which the timer having been activated in step 602 is counted. Until a predetermined time period has passed, the program returns to step 606 to repeat the steps 606 and 608. After a predetermined time period has passed, the program proceeds to step 6091, in which the timer is reset. The program further proceeds to step 610, in which the control signal A continues to be at L, as well as the control signal B and control signal C are set from H to L. By this step 610, the first switching element 20 continues to be OFF, and the second switching element 24 and third switching element 26 are changed from ON to OFF interrupting the excitation current to the electromagnetic solenoid 27 at a high speed.

In the subsequent step 611, it is determined whether or not the excitation current I to the electromagnetic solenoid 27 comes to be not more than the attenuation determination current Ic by monitoring whether or not an output from the first comparison amplifier 35*b* is a logic level L. In the case where the excitation current I is not more than Ic, the program returns to step 610 to repeat the step 610 and step 611. In the case where the excitation current I to the electromagnetic solenoid 27 is determined to be not more than Ic in step 611, the program proceeds to step 612. In this step 612, it is determined whether or not a logic level of the valve-opening signal PL1 has returned from H to L. In the case where PL1 has not returned to L, the control signal C is returned to H again in step 613, and the program proceeds to step 614. In this step 614, it is determined whether or not the excitation current I to the electromagnetic solenoid 27 has decreased to not more than the lower limit Ie of the feedback control by monitoring whether or not an output from the second comparison amplifier 35*b* is at a logic level L.

When the excitation current I is determined to be not more than Ie, the program proceeds to step 615. In this step 615, the control signal A continues to be at L, the control signal B is changed from L level to H level, and the control signal C continues to be at H. Thus, the first switching element 20 continues to be OFF, and the second switching element 24 and third switching element 26 are ON. Therefore the open-valve hold power feed is performed to the electromagnetic solenoid 27, and this excitation current is kept at not less than the lower limit Ie. The program proceeds to step 616 subsequently to step 615, or when the excitation current I is not determined less than Ie. In this step 616, it is determined whether or not the excitation current I to the electromagnetic solenoid 27 is not less than Id, being the upper limit of the feedback control, by monitoring whether or not an output from the second comparison amplifier 35*b* is at a logic level H.

In the case where the excitation current I is not less than Id, the program proceeds to step 617, in which the control signal A is maintained at L, the control signal B is changed from H to L, and the control signal C is maintained at H. Accordingly, in this step 617, although the first switching element 20 continues to be OFF and the second switching element 24 is brought into OFF, the third switching element 26 continues to be ON to bring the excitation current to the electromagnetic solenoid 27 into smooth attenuation. When the excitation current I is not more than Id in step 616 as well as after the processing of step 616t, the program returns to step 612. As long as the determination in step 612 is NO, the program repeats operations in steps 612 to 617, that is a block showing step 618 enclosed by dot lines of FIG. 6. Thus, the excitation current to the electromagnetic solenoid 27 is controlled so as to be in a range of Ie–Id. Further, these steps 612 to 617, also collectively indicated by step 618, performs the feedback control as holding current control means.

When the valve-opening signal PL1 remains at a logic level L in the mentioned step 601, or when the valve-opening signal PL1 has changed to a logic level L in step 612, the program proceeds to step 619. In this step 619, all the control signals A, control signal B and control signal C are set to logic level L. Accordingly, in this step 619, all the first switching element 20, second switching element 24 and third switching element 26 are in an OFF state so that the power feed to the electromagnetic solenoid 27 is stopped.

After the above-mentioned processing has been performed in step 619, the program proceeds to step 620. In this step 620, it is determined whether or not a predetermined time period has passed by monitoring operation of the power supply timer, not shown, which outputs a time-up output after the predetermined time period has passed since turning on the key switch 2. This predetermined time period is set, e.g., to a time period necessary for the capacitor 9 of the auxiliary power supply 6 to be charged from 0V to the maximum voltage Vpmax when voltage of the main power supply 1 is at the minimum value Vpmax. In the case where a predetermined time period has passed in this step 620, the program proceeds to step 621, in which it is determined whether or not an output voltage of the auxiliary power supply 6 is, for example, not less than a predetermined minimum voltage Vpmix. This determination is implemented by monitoring an output from a comparison circuit, not shown, which is connected to the logic circuit 16*b*.

When the determination in step 621 is NO, that is, when the output voltage from the auxiliary power supply 6 is not more than Vpmin, the program proceeds to step 622, in which an error signal output ER is set. Further, when the determination in step 621 is YES, when a predetermined time period has not passed in the above-mentioned step 620, and after the error signal has set in step 622, the program proceeds to step 622 being an operation end step. In this step 622, the logic circuit 16 performs standby for implementing other controls, and returns to step 600 being the operation start step.

In the case where the error signal output ER is set in step 607 or step 622, the CPU4*a* is arranged to make a generation time of the valve-opening signal PL1 earlier, or to make the end time of the valve-opening drive signal PL2 later. Thus, output time period of the valve-opening drive signal PL2 is extended and starts operation of the alarm display 33. As a result, even in the case of occurring an error in the auxiliary power supply 6 thereby no sufficient output voltage being obtained, current from the main power supply 1 is fed from the second switching element 24 to the electromagnetic solenoid 27 via the back-flow prevention diode 40. Therefore, although a response delay occurs, the valve-opening operation of the fuel injection valve is performed, and consequently an evacuation operation can be carried out. Thus, the step 621 functions as auxiliary power supply error detection means, and the step 622 functions as auxiliary power supply error-processing means.

Additionally, in the case where an error signal output ER is generated instep 607 or step 622, not only a valve-opening drive time period is extended, but also a value of a peak current Ia is set to be rather low. In the case where the error signal output ER is still generated in step 306 in spite of taking such procedures, a power feed stop signal is generated, whereby a power feed to the electromagnetic solenoid 27 can be stopped.

In the control device of a fuel injection valve according to this second embodiment of the invention arranged as described above, the first switching element 20 and second switching element 24 are constructed in series in addition to the case of the foregoing first embodiment. In the case of the occurrence of any short circuit failure at the first switching element 20, either the second switching element 24 or the third switching element 26 is OFF, thereby enabling to interrupt current flowing through the electromagnetic solenoid 27. Further, the current detection means is constituted of a pair of comparison amplifiers, the first comparison amplifier 35*a* is an alternative of the peak current detection means and the transient-decay current detection means, and the second comparison amplifier 35*b* is an alternative of the holding current control means. Therefore, it is unnecessary to convert the current flowing through the electromagnetic solenoid 27 into a digital value to perform numeric operation, or to implement any comparative determination at any numerical value level by means of the CPU. As a result, it is now possible to simplify a circuit and reduce load on the CPU4*b*.

Embodiment 3.

FIGS. 7 and 8 are to explain a control device of a fuel injection valve according to a third preferred embodiment of the invention. FIG. 7 is a general circuit diagram explaining a constitution. FIG. 8 shows a constitution of an error detection circuit. The general circuit diagram of FIG. 7 shows a driving electromagnetic solenoid of a fuel injection valve mounted on respective cylinders of a four-cylinder internal combustion engine. This driving electromagnetic solenoid is arranged such that a pair of fuel injection valves, which do not perform adjacent valve-opening operation, commonly use first and second switching elements and a current detection resistor. Further, the first and second switching elements are connected in parallel as shown in FIG. 1 of the foregoing first embodiment, and a CPU implements operation of a feed controlling logic circuit. In addition, although only reference numerals are shown in a block Z enclosed within the dot lines in the diagram, this block is the same circuit as a block Y, and only reference numerals of components are shown in correspondence to those in the circuit of the block Y.

Referring now to FIG. 7, the main power supply 1 is an on-vehicle battery, for example, of DC 12V, an electric power is fed from the main power supply 1 to a control device described later, via the key switch 2. Actual voltage of the main power supply 1 varies from the minimum value Vbmin=10V to the maximum value Vbmax=16V. An electric power of the main power supply 1 is supplied to the constant voltage power supply 3, where it is converted into a stable constant voltage, for example, DC5V to be supplied to a CPU4*c*. The CPU4*c* is provided with a nonvolatile memory MEM such as flash memory or a RAM for an operation processing and an AD converter converting an analog signal into a digital value. In addition, an input sensor group, not shown, is connected to the mentioned CPU4*c*. This input sensor group consists of a large number of ON,/OFF sensors and analog sensors such as rotation sensor of internal combustion engine, crank angel sensor, airflow sensor, cylinder pressure sensor, air/fuel ratio sensor, cooling water temperature sensor.

The CPU4*c* generates control signals A1·B1·C1, A2·B2·C2, A3·B3·C3, A4·B4·C4 individually for each cylinder in response to detection signals from the mentioned input sensor group and a program content of the mentioned nonvolatile memory MEM. For example, in the case of a four-cylinder internal combustion engine, four fuel injection valves are mounted. In FIG. 7, two fuel injection valves, which do not perform an adjacent valve-opening operation, are shown forming a pair along with a drive circuit. The other pair of fuel injection valves and the drive circuits are shown only showing reference numbers within a frame Z enclosed by the dot lines, omitting a circuit diagram thereof. Electromagnetic solenoids of four fuel injection valves are 27*a* and 27*c*, and 27*b* and 27*d* within the frame z, and operation order of respective electromagnetic solenoids is 27*a*→27*b*→27*c*→27*d*→27*a*.

The auxiliary power supply 6 is of the same construction and operation as that described in FIG. 1 according to the first embodiment, and outputs a rapid power feed. Accordingly, in the same manner as in the foregoing first embodiment, a comparator 15*c* is connected to the auxiliary power supply 6. An output logic level of the comparator 15*c* comes to be L when a first switching element 20*a* or 20*b*, described later, is ON to prohibit charging a capacitor disposed in the auxiliary power supply 6. The rapid power feed of the auxiliary power supply 6 is supplied to the first switching elements 20*a* and 20*b* consisting of bipolar-type or field effect-type power transistors. Signals A13 and A24 are sent to the first switching elements 20*a* and 20*b* via base resistors 17*a* and 17*b*, drive transistors 18*a* and 18*b*, and drive resistors 19*a* and 19*b*. Furthermore, the first switching element 20*a* supplies outputs from the auxiliary power supply 6 to electromagnetic coils 27*a* and 27*c*, and the first switching element 20*b* supplies the outputs from the auxiliary power supply 6 to electromagnetic coils 27*b* and 27*d*.

The second switching elements 24*a* and (24*b* in the frame Z) are driven in response to the signal B13 and (signal B24) via base resistors 21*a* and (21*b* in the frame Z), drive transistors 22*a* and (22*b* within the frame Z) and drive resistors 23*a* and (23*b* within the frame Z). The second switching elements 24*a* and 24*b* are constituted of the bipolar-type or field effect-type power transistors. The second switching elements 24*a* and 24*b* supply a continuous current from the main power supply 1 to the electromagnetic solenoids 27*a* to 27*d* via the back-flow prevention diodes 28*a* (and 28*b* in the frame Z). A control signal B13 corresponds to OR of the control signals B1 and B3. When this control signal B13 comes to logic level H, the second switching element 24*a* is brought into conduction via the drive transistor 22*a*, and the continuous power feed to the electromagnetic solenoid 27*a* or 27*c* is performed from the main power supply 1. When a control signal B24, which corresponds to OR of the control signals B2 and B4, comes to logic level H, the second switching element 24*b* is brought into conduction via the drive transistor 22*b* in the frame Z, not shown. Thus, the continuous power feed to the electromagnetic solenoid 27*b* or 27*d* is performed from the main power supply 1.

A third switching element 26*a*–26*d* is constituted of a bipolar-type or field effect-type power transistor having an interruption voltage limiting function of a higher value than the maximum output voltage from the auxiliary power supply 6. The third switching elements 26*a* and 26*c* are connected to a current detection resistor 29*a*, and the electromagnetic solenoid 27*a*, third switching element 26*a* and current detection resistor 29*a* form a series circuit. Further, the electromagnetic solenoid 27*c*, third switching element 26*c* and current detection resistor 29*a* form a series circuit. To these series circuits, a communicating diode 30*a* is connected in parallel. Furthermore, the third switching elements 26*a* and 26*c* are driven in response to a control signals CC1 and CC3 via drive resistors 25*a* and 25*c*.

Likewise, within the frame Z enclosed by the dote lines, not shown, the third switching elements 26*b* and 26*d* are connected to the current detection resistor 29*b*, and the electromagnetic solenoid 27*b*, third switching element 26*b* and current detection resistor 29*b* form a series circuit. Further, the electromagnetic solenoid 27*d*, third switching element 26*d* and current detection resistor 29*b* form a series circuit. Furthermore, to these series circuits, a communicating diode 30*b* is connected in parallel. These third switching elements 26*a*–26*d* are brought into conduction when control signals CC1–CC4 come to logic level H, thereby enabling to perform the power feed from the main power supply 1 or the auxiliary power supply 6 to the electromagnetic solenoid 27*a*–27*d*.

Current of the electromagnetic solenoid 27*a* or 27*c* (electromagnetic solenoid 27*b* or 27*d*) is detected by the current detection resistor 29*a* (29*b*). Voltage across the current detection resistors 29*a* and (29*b*) is inputted to amplifier circuits 43*a* and 43*b*, and outputs from the amplifier circuits 43*a* and 43*b* are inputted to element error detection circuits 44*a* and 44*b* in response to the outputs from the amplifier circuits 43*a* and 43*b*. Output signals AN13 and AN24 from the amplifier circuit 43*a* and 43*b*, and error signal outputs ER1 and ER2 from the element error detection circuits 44*a* and 44*b* are inputted to the CPU4*c*. Upon generation of the error signal outputs ER1 and ER2, an alarm display 33, which is driven by the CPU4*c*, operates in response thereto, and indicates an alarm.

Furthermore, the rapid power feed is carried out in the following manner. That is, when the control signal A13 corresponding to OR of the control signals A1 and A3 comes to logic level H, the first switching element 20*a* is brought into conduction via the drive transistor 18*a* to apply a high voltage from the auxiliary power supply 6 to the electromagnetic solenoid 27*a* or 27*c*. When the control signal A24 corresponding to a logical addition of the control signals A2 and A4 comes to logic level H, the first switching element 20*b* is brought into conduction via the drive transistor 18*b* to apply a high voltage from the auxiliary power supply 6 to the electromagnetic solenoid 27*b* or 27*d*.

A comparator 15*c* controls the operation of the auxiliary power supply 6. An input resistance 45 is connected to a negative-side input terminal of the comparator 15*c*, and an input resistance 46 is connected to a positive-side input terminal between the key switch 2 and this positive-side input terminal. Further, signals from the output terminal of the first switching elements 20*a* and 20*b* are inputted to the negative-side input terminal of the comparator 15*c* via the input resistor 45 and the diodes 41*a* and 41*b*. The output terminal of the comparator 15*c* is inputted to a gate circuit, not shown, of the auxiliary power supply 6. When the first switching element 20*a* or 20*b* is ON to perform the rapid power feed in response to the A13 signal or A24 signal, a logic level output from the comparator 15*c* comes to be L and, as a result, step-up operation of the auxiliary power supply 6 is stopped.

In addition, each control signal shown in FIG. 7 is now described. The control signal A2–A4 bring the first switching element 20*a* or 20*d* into conduction to perform the rapid power feed, as well as stop the charge operation of the auxiliary power supply 6 during the rapid power feed. Further, the control signals B1–B4 bring the second switching element 24*a* or 24*d* into conduction to perform the continuous power feed, as well as implement ON/OFF ratio control to perform the open-valve holding control. The control signals C1–C4 at bring selectively the third switching elements 26*a*–26*d* into conduction at the time of a logic level H, as well as bring the third switching elements 26*a*–26*d* into OFF at the time of logic level L to perform interruption of the excitation current to the electromagnetic solenoid at a high speed. Preparing the program shown in the flowchart of FIG. 3 described in the foregoing first embodiment for four electromagnetic solenoids respectively, and storing the programs in the nonvolatile program memory MEM of the CPU4*c* achieve the mentioned operations of these control signals.

Now, the pair of element error detection circuits (means) 44*a* and 44*b* forming an identical circuit, are described in detail with reference to FIG. 8, taking the element error detection circuit 44*a* as a typical one. Referring to FIG. 8, the element error detection circuit 44*a* includes: comparators 47*a* and 47*b*, and 50*a* and 50*b*; a differential circuit 48 consisting of a differential capacitor 48*a*, a series resistance 48*b*, and voltage-dividing resistances 48*c* and 48*d*; determination threshold generation means 49*a* and 49*b*, and 51*a* and 51*b*; timers 52*a*–52*c*; AND elements 53*a*–53*c*; OR elements 54*a* and 54*b*; storage elements 55*a* and 55*b* constituted of, e.g., flip flop circuits; and a power supply turning-on pulse generation circuit 39 for resetting these storage elements 55*a* and 55*b*.

The comparator 47*a* acts as short circuit error detection means for the first or third switching element. The differential circuit 48 generates an output obtained by adding a value proportional to rate of change in output voltage from the amplifier circuit 43*a* or 43*b*, and a value proportional to an output voltage from the amplifier circuit 43*a* or 43*b*. A determination threshold outputted by the determination threshold generation means 49*a* is a rate of change in voltage output from the amplifier circuit 43*a* and 43*b* when the auxiliary power supply 6 performs the rapid power feed to any one of the electromagnetic solenoids 27*a*–27*d*. Further, this determination threshold is set to a value rather larger than an output voltage from the differential circuit 48 at the time of an excitation current not more than the first threshold detected by the peak current detection means. Output from the differential circuit 48 is connected to the positive-side input terminal of the comparator 47*a*, and determination threshold of the determination threshold generation means 49*a* is connected to the negative-side terminal of the comparator 47*a*.

Accordingly, for example, in the element error detection circuit 44*a*, when a short circuit error occurs at the third switching element 26*c*, the third switching element 26*a* is brought into conduction to perform the rapid power feed to the electromagnetic solenoid 27*a* being the one forming the pair and, consequently, the rapid power feed to the electromagnetic solenoids 27*a* and 27*c* is performed from the first switching element 20*a*. Therefore, the differential circuit 48 generates substantially twice as large as the differential output as compared with a normal differential value. As a result, the comparator 47*a* generates a short circuit error determination output concerning the third switching element 26*a* or 26*c*. Further, even in the case where there is no short circuit error at the third switching elements 26*a* and 26*c*, if the first switching element 20*a* is in the short circuit error, the rapid power feed by means of the auxiliary power supply 6 continues even after the peak current detection means has made an excess determination. Therefore, the excitation current to the electromagnetic solenoid exceeds the first threshold and, as a result, an output from the differential circuit 48 becomes excessively large so that the comparator 47*a* determines a short circuit error as to the first switching element 20*a*.

The comparator 47*b* is to act as disconnection error detection means of the first switching element. The determination threshold generation means 49*b* is set to a value rather larger than step up rate of in the excitation current when directly applying voltage of the main power supply 1 to the electromagnetic solenoid. The timer 52*a* generates a time-up output of a logic level H when the control signal A13 or A24 comes to logic level H and after passing a minute time necessary for the excitation current to the electromagnetic solenoid to start rising exactly. A signal voltage, which corresponds to a determination threshold of the determination threshold generation means 49*b*, is applied to the positive-side input terminal of the comparator 47*b*, and an output voltage from the differential circuit 48 is applied to the negative-side input terminal of the comparator 47*b*. Then, output from these comparator 47*b* and output from the timer 52*b* are inputted to the AND element 53*a*.

Accordingly, when the control signal A13 or A24 comes to logic level H and the rapid power feed is started, output from the comparator 47*b* normally comes to logic level L. However, when the first switching element 20*a* is in a disconnection error, any output from the differential circuit 48 is not generated, and the output from the comparator 47*b* comes to logic level H as being an error determination output. Even in the case where the first switching element 20*a* is not in any disconnection error but any step-up voltage error occurs such that an output voltage from the auxiliary power supply 6 may equal to voltage of the main power supply 1, the output voltage from the differential circuit 48 becomes smaller than the determination threshold of the determination threshold generation means 49*b*. Consequently, the comparator 47*b* outputs a logic level H as an error determination output.

The comparator 50*a* is to act as short circuit error detection means of the first or second switching element. A threshold value outputted by the determination threshold generation means 51*a* is a determination threshold value corresponding to an output voltage from the amplifier 49*a* or 43*b* when flowing an excitation current rather larger than the upper limit Id (referring to FIG. 2*c*) of the excitation current in the open-valve holding control of the electromagnetic solenoids 27*a*–27*d*. The positive-side input terminal of the comparator 50*a* is connected to an output terminal of the amplifier circuit 43*a* or 43*b*, and a signal voltage corresponding to a determination threshold outputted by the determination threshold generation means 51*a* is applied to the negative-side input terminal of the comparator 50*a*.

The timer 52*b* is activated when the control signal A13 or A24 comes to logic level H, and outputs a time-up signal of logic level H at the moment of starting an open-valve hold control after a predetermined time period has passed. The AND element 53*b* inputs an output signal from the comparator 50*a* and an output signal from the timer 52*b*. The comparator 50*b* is to act as disconnection error detection means for the second and third switching elements. The determination threshold generation means 51*b* outputs a determination threshold corresponding to the output voltage from the amplifier circuit 43*a* or 43*b* when flowing an excitation current rather smaller than the lower limit Ie (referring to FIG. 2*c*) of the excitation current in an open-valve holding control of the electromagnetic solenoids 27*a*–27*d*. The negative-side input terminal of the comparator 50*b* is connected to an output terminal of the amplifier circuit 43*a* or 43*b*, and a signal voltage, which corresponds to a determination threshold of the determination threshold generation means 51*b*, is applied to the positive-side input terminal of the comparator 50*b*.

The timer 52*c* is activated when the control signal A13 or A24 comes to logic level H, and outputs a time-up signal of logic level H at the moment when passing a minute delay time at which current flowing through the electromagnetic solenoid begins to step up. Output signal from the comparator 50*b* and output signal from the timer 52*c* are inputted to the AND element 53*c*. Further, it is also possible that the timer 52*b* is commonly used in place of the timer 52*c*. In this case, a detection time period range of disconnection error is reduced, and therefore the comparator 50*b* cannot detect the disconnection error occurred in the first switching elements 20*a* and 20*b*.

The OR element 54*a* inputs an output signal from the comparator 47*a* and an output signal from the AND element 53*b*. Inputted to the OR element 54*b* are an output signal from the AND element 53*a*, an output signal from the comparator 47*a*, an output signal from the AND element 53*b* and an output signal from the AND element 53*c*. The storage element 55*a* is set in response to an output from the OR element 54*a*, and the storage element 55*b* is set in response to an output from the OR element 54*b*. Furthermore, the power supply turning-on pulse generation circuit 39 detects that the key switch 2 is turned on, outputs a pulse signal, and performs initialization reset of the storage elements 55*a* and 55*b*. A reset output from the storage element 55*a* is delivered to gate elements 56*a*–56*d* or 57*a*–57*d*, described later, as a gate signal output GT1 or GT2, and a reset output from the storage element 55*b* is inputted to the CPU4*c* as the error signal output ER1 or ER2.

Referring again to the general circuit diagram of FIG. 7, the element error detection circuit 33*a* performs a short circuit error determination of the first switching element 20*a* or the third switching elements 26*a* and 26*c* by means of the comparator 47*a* shown in FIG. 8, or performs a short circuit error determination of the first switching element 20*a* or the second switching element 24*a* by means of the comparator 50*a*. Further, the element error detection circuit 44*a* performs a disconnection error determination of the first switching element 20*a* and an error determination of the auxiliary power supply 6 by means of the comparator 47*b* in FIG. 8, or performs a disconnection error determination of the second switching element 24*a* or the third switching element 26*a* or 26*c* by means of the comparator 50*b*. Furthermore, the element error detection circuit 44*a* generates the error signal output ER1 at logic level L by means of the storage element 55*b* until the key switch 2 is turned on again after the error has occurred, or generates a gate signal output GT1 for the gate elements 56*a*–56*d* by means of the storage element 55*a* when occurrence of any short circuit error is determined.

The element error detection circuit 44*b* is arranged similarly, and performs a short circuit error determination of the first switching element 20*b* or the third switching element 26*b* or 26*d* by means of the comparator 47*a* in FIG. 8, and performs a short circuit error determination of the first switching element 20*b* or the second switching element 24*b* by means of the comparator 50*a*, or performs a disconnection error determination of the first switching element 20*b* or an error determination of the power supply 6 by means of the comparator 47*b*. Further, this element error detection circuit 44*b* performs a disconnection error determination of the second switching element 24*b* or the third switching element 26*b* or 26*d* by means of the comparator 50*b* in FIG. 8. Furthermore, this element error detection circuit 44*b* outputs the error signal output ER2 at logic level L by means of the storage element 55*b* until the key switch 2 is turned on again after the error has occurred, or generates a gate signal output GT2 for the gate elements 57*a*–57*d* by means of the storage element 55*a* when occurrence of any short circuit error is determined.

As described above, in this second embodiment, a short circuit error of the first switching elements 20*a* and 20*b* is detected on both sides of the comparator 47*a* and the comparator 50*a* of FIG. 8. Therefore, it is also possible to remove at the differential circuit 48 a proportional share by the voltage-dividing resistors 48*c* and 48*d*, and bring the operation into a state that any detection cannot be performed on the comparator 47*a* side.

The gate element 56*a* generates a control signal A13 as an AND output obtained from an OR signal of the control signals A1 and A3 generated by the CPU4*c* and the mentioned gate signal output GT1. When the element error detection circuit 44*a* generates an error output by the foregoing gate element 56*a*, the control signal A13 is arranged so as to be at logic level L. The gate element 56*b* generates a control signal B13 as an AND output obtained from an OR signal of the control signals B1 and B3 generated by the CPU4*c* and the gate signal output GT1. When the element error detection circuit 44*a* generates an error output by the foregoing gate element 56*b*, the control signal B13 is arranged so as to be at logic level L.

The gate element 56*c* and the gate element 56*d* generate control signals CC1 and CC3 respectively as an AND output of the control signals C1 and C3 generated by the CPU4*c* and the above-mentioned gate signal output GT1. When the element error detection circuit 44*a* generates an error output by these gate elements 56*c* and 56*d*, the control signals CC1 and CC3 are arranged so as to be at logic level L. Likewise, gate elements 57*a*–57*d* generate control signals A24, B24, CC2, CC4 corresponding to the operation of the element error detection circuit 44*b*.

In the control device of a fuel injection valve according to the third embodiment of the invention of the above-described arrangement, turning ON the key switch 2 brings the CPU4*c* into operation. To drive four fuel injection valves mounted on the four-cylinder internal combustion engine, the control signals A1·B1·C1, the control signals A2·B2·C2, the control signals A3·B3·C3, and the control signals A4·B4·C4 are generated sequentially to be fed to the electromagnetic solenoids 27*a*–27*d*. Power feed to the electromagnetic solenoids is performed in order of 27*a*→27*b*→27*c*→27*d*→27*a*. Subsequently, the respective control signals are sorted and organized into the control signals A13·B13·CC1·CC3 and A24·B24·CC2·CC4 in correspondence to the gate elements 56*a*–56*d* and the gate elements 57*a*–57*d* conforming to the operation state associated with the element error detection circuits 44*a* and 44*b* respectively.

The first switching element 20*a* performs the rapid power feed to one of the electromagnetic solenoids 27 and 27*c* selected by the third switching element 26*a* or 26*c*. During this rapid power feed time period, the control signal A13 and control signal B13 are at a logic level H, and a valve-opening operation of the fuel injection valve is started. When the control signal A13 comes to logic level L and the first switching element 20*a* is brought into OFF, a continuous power feed to the electromagnetic solenoid 27*a* or 27*c* is performed from the second switching element 24*a* being ON in response to the control signal B13. During this continuous power feed time period, operation of the moving section of the fuel injection valve is terminated and settled.

Subsequently, logic level of the control signal B13 is changed alternately between H and L, whereby the second switching element 24*a* performs an ON-OFF operation, thus an open-valve holding current to the electromagnetic solenoid 27*a* or 27*c* is supplied. This open-valve holding current is set to a current value as small as possible not less than the minimum current value enabling the electromagnetic solenoid 27*a* or 27*c* to hold valve open. The third switching elements 26*a* and 26*c* are selectively brought into conduction to be controlled in response to the control signals CC1 and CC3, and arranged so as to speedily attenuate an excessive transient-decay current during the open-valve hold time period or to reduce a valve-closing operation delay due to gradual transient-decay current, thereby enabling to perform rapid valve-closing operation.

Likewise, the first switching element 20*b* performs a rapid power feed to one of the electromagnetic solenoids 27*b* and 27*d* selected by the third switching element 26*b* or 26*d*. During this rapid power feed time period, the control signal A24 comes to logic level H to start a valve-opening operation of the fuel injection valve. When the control signal A 24 comes to logic level L and the first switching element 20*b* is brought into OFF, the control signal B24 comes to logic level H, and the second switching element 24*b* is brought into conduction, whereby the continuous power feed to the electromagnetic solenoid 27*b* or 27*d* is performed. During this continuous power feed time period, operation of the moving section of the fuel injection valve is terminated and settled.

Subsequently, logic level of the control signal B24 is changed alternately between H and L, whereby the second switching element 24*b* performs an ON-OFF operation, thus an open-valve holding current to the electromagnetic solenoid 27*b* or 27*d* is supplied. This open-valve holding current is set to be a current value as small as possible not less than the minimum current value enabling the electromagnetic solenoid 27*b* or 27*d* to hold valve open. The third switching elements 26*b* and 26*d* are brought into conduction selectively to be controlled in response to the control signals CC2 and CC4, and arranged so as to speedily attenuate an excessive transient-decay current during the open-valve holding time period or to reduce a valve-closing operation delay due to gradual transient-decay current enabling to perform rapid valve-closing operation.

When the element error detection circuit 44*a* performs a short circuit error determination of the first switching element 20*a*, second switching element 24*a*, or third switching element 26*a* or 26*c*, and a logic level of the gate signal output GT1 comes to be L, the control signals A13·B13·CC1·CC3 come to logic level L as well. Thus, all the elements, which are not in a state of short circuit error, among the first switching element 20*a*, second switching element 24*a* and third switching elements 26*a* and 26*c* come to a state of non-conduction, and operation of a pair of the fuel injection valves, which perform a valve-opening operations alternately at regular intervals, is stopped.

However, operations of the electromagnetic solenoids 27*a* b and 27*d*, which drives the other pair of fuel injection valves, are continued by the first switching element 20*b*, second switching element 24*b* and third switching elements 26*b* and 26*d*, thereby enabling an evacuation operation. Furthermore, when the element error detection circuit 44*a* performs a short circuit error determination or a disconnection error determination as to the first switching element 20*a*, second switching element 24*a* or third switching elements 26*a* or 26*c* and generates the error signal output ER1, the alarm display 33 comes to be operated by means of the Cpu4*c*.

On the contrary, when the element error detection circuit 44*b* performs a short circuit error determination of the first switching element 20*b*, second switching element 24*b* or third switching element 26*a* or 26*c* and logic level of the gate, signal output GT2 comes to L, the control signals A24·B24·CC2·CC4 come to logic level L as well. Thus, all the elements, which are not in a state of short circuit error, among the first switching element 20*b*, second switching element 24*b* and third switching elements 26*b* and 26*d* are brought into non-conduction, and operation of a pair of the fuel injection valves, which perform a valve-opening operations alternately at regular intervals, is stopped.

However, operations of the electromagnetic solenoids 27*a* band 27*c*, which drives the other pair of fuel injection valves, are continued by the first switching element 20*a*, second switching element 24*a* and third switching elements 26*a* and 26*c*, thereby enabling an evacuation operation. Furthermore, when the element error detection circuit 44*b* performs a short circuit error determination or a disconnection error determination for the first switching element 20*b*, second switching element 24*b* or third switching elements 26*b* or 26*d* and outputs the error signal output ER2, the alarm display 33 comes to be operated by means of the Cpu4*c*.

In this second embodiment, when occurring any short circuit error at either the first switching elements 20*a* or 20*b*, the element error detection circuit 44*a* or 44*b* detects this short circuit error, and any one pair of the third switching elements 26*a* and 26*c*, and the third switching elements 26*b* and 26*d* comes to be OFF. As a result, an evacuation operation using the electromagnetic solenoid on the side of the remaining pair of switching elements is carried out. Furthermore, in the case where step-up operation of the auxiliary power supply 6 becomes impossible or a disconnection error occurs such that the first switching element 20*a* or 20*b* is incapable of.;being conductive, all the electromagnetic solenoids 27*a*–27*d* are brought into operation by means of the main power supply 1, the second switching element 24*a* or 24*b*, and the third switching elements 26*a*–26*d*, eventually to be capable of carrying out an evacuation operation. However, since any delay in operation response of the fuel injection valve occurs in the evacuation operation, fuel injection with an accurate amount cannot be performed. In addition, the alarm display 33 operates also in response to the error signal output ER corresponding to step 306 and step 319 of FIG. 3 shown in the foregoing first embodiment other than the mentioned error signal outputs ER1 and ER2.

As described above, in this third embodiment, the first switching element, second switching element and current detection means are shared or commonly used with respect to the fuel injection valves operating alternately at regular intervals, thereby enabling to reduce number of parts and achieve a smaller-sized device. In addition, when occurring any trouble at any one pair of the switching elements, each switching element is brought into OFF as to the pair on the side of occurrence of the trouble, thereby enabling to carry out an evacuation operation using the remaining pair. Consequently, it is possible to protect the electromagnetic solenoid of the fuel injection valve on the side of occurrence of the trouble from, e.g., burnout, and to inform a driver of the trouble.

Embodiment 4.

FIGS. 9 and 10 are to explain a control device of a fuel injection valve according to a fourth preferred embodiment of the invention. FIG. 9 is a general circuit diagram for explaining constitution, and FIG. 10 shows a constitution of an error detection circuit. The general circuit diagram of FIG. 9 shows a driving electromagnetic solenoid of a fuel injection valve provided for respective cylinders of a four-cylinder internal combustion engine. This driving electromagnetic solenoid is arranged such that a pair of fuel injection valves, which do not perform adjacent valve-opening operation, commonly use first and second switching elements and a current detection resistor. Further, the first and second switching elements are connected in series as shown in FIG. 4 of the foregoing second embodiment.

As shown in FIG. 9, also in this fourth embodiment, an electric power is fed to a CPU4*d* from the constant voltage power supply 3. The CPU4*d* is provided with a nonvolatile memory NEM such as flash memory, a RAM for an operation processing, and an AD converter for converting an analog input signal into a digital signal. Further, in the same manner as in the foregoing first embodiment, an input sensor group, not shown, is connected to the CPU4*d*. This input sensor group consists of a large number of ON/OFF sensors and analog sensors such as rotation sensor of internal combustion engine, crank angel sensor, airflow sensor, cylinder pressure sensor, air/fuel ratio sensor, cooling water temperature sensor.

The CPU4*c* generates control signals A1·B1·C1, A2·B2·C2, A3·B3·C3, A4·B4·C4 individually for each cylinder in response to detection signals from the mentioned input sensor group and a program content of the mentioned nonvolatile memory MEM. For example, in the case of a four-cylinder internal combustion engine, four fuel injection valves are mounted. In FIG. 9, however, the electromagnetic solenoids 27*a*–27*d*, which drive a valve body of respective fuel injection valves, are provided so that two fuel injection valves, which do not perform a valve-opening operation adjacently, may form a pair. The electromagnetic solenoids of the four fuel injection valves perform a valve-opening operation in order of 27*a*→27*b*→27*c*→27*d*→27*a*.

The auxiliary power supply 6 has the same constitution and operation as that described referring to FIG. 1 of the foregoing first embodiment. Output of rapid power feed from the auxiliary power supply 6 is supplied to the electromagnetic solenoids 27*a* and 27*c* as well as to the electromagnetic solenoids 27*b* and 27*d* via the first switching elements 20*c* and 20*d* as well as the second switching elements 24*c* and 24*d*, which are in series with the first switching elements 20*c* and 20*d*. The first switching elements 20*c* and 20*d* and the second switching elements 24*c* and 24*d* are all constituted of bipolar-type or field effect-type power transistors. Then, the first switching elements 20*c* and 20*d* are driven in response to control signals A13 and A24 via base resistors 17*c* and 17*d*, drive resistor 18*c* and 18*d*, and drive resistors 19*c* and 19*d*.

The control signal A13 corresponds to OR of the mentioned control signals A1 and A3. When the control signal A13 comes to logic level H, the first switching element 20*c* is brought into conduction via the drive transistor 18*c*, and a high voltage from the auxiliary power supply 6 is applied to the electromagnetic solenoid 27*a* or 27*c* via the second switching element 24*c*. The control signal A24 corresponds to OR of the control signals A2 and A4. When the control signal A24 comes to logic level H, the first switching element 20*d* is brought into conduction via the drive transistor 18*d*, and a high voltage of the auxiliary power supply 6 is applied to the electromagnetic solenoid 27*b* or 27*d* via a second switching element 24*d*.

The second switching elements 24*c* and 24*d* are driven in response to control signals B13 and B24 via the base resistors 21*c* and 21*d*, drive transistors 22*c* and 22*d* and drive resistors 23*c* and 23*d*. The second switching elements 24*c* and 24*d* are connected so that the continuous power feed may be performed from the main power supply 1 to the electromagnetic solenoids 27*a* and 27*c* as well as to the electromagnetic solenoids 27*b* and 27*d* via back-flow prevention diodes 40*c* and 40*d*. A control signal B13 corresponds to OR of control signals B1 and B3. When this control signal B13 comes to logic level H, the second switching element 24*c* is brought into conduction via the drive transistor 22*c*, and the continuous power feed is performed to the electromagnetic solenoid 27*a* or 27*c*. A control signal B24 corresponds to OR of control signals B2 and B4. When the control signal B24 comes to logic level H, the second switching element 24*b* is brought into conduction via the drive transistor 22*d*, and the continuous power feed is performed to the electromagnetic solenoid 27*b* or 27*d*.

Third switching elements 26*a*–26*d* are constituted of bipolar-type or field effect-type power transistors having an interruption voltage limiting function larger than the maximum output voltage from the auxiliary power supply 6. The third switching elements 26*a* and 26*c* are connected to a current detection resistor 29*c*. The electromagnetic solenoid 27*a*, the third switching element 26*a* and the current detection resistor 29*c* form a series circuit. Further, the electromagnetic solenoid 27*c*, the third switching element 26*c* and the current detection resistor 29*c* form a series circuit. A communicating diode 30*c* is connected in parallel to these series circuits. The third switching elements 26*a* and b26*c* are driven in response to control signals CC1 and CC3 via drive resistor 58*a* and 58*c*.

The third switching elements 26*b* and 26*d* are connected to the current detection resistor 29*d*. The electromagnetic solenoid 27*b*, the third switching element 26*b* and the current detection resistor 29*d* form a series circuit. In addition, the electromagnetic solenoid 27*d*, the third switching element 26*d* and the current detection resistor 29*d* form a series circuit. A communicating diode 30*d* is connected in parallel to these series circuits. Further, the third switching elements 26*b* and 26*d* are driven in response to control signals CC2 and CC4 via drive resistors 28*b* and 58*d*. When the control signals CC1–CC4 come to logic level H, the third switching elements 26*a*–26*d* are brought into ON, enabling to perform the power feed to the electromagnetic solenoids 27*a*–27*d* from the main power supply 1 or the auxiliary power supply 6.

An anode side of a diode 59*a* is connected to a connection point between the electromagnetic solenoid 27*a* and third switching element 26*a*, and an anode side of a diode 59*c* is connected to a connection point between the electromagnetic solenoid 27*c* and third switching element 26*c*. The diode 59*a* and the diode 59*c* are connected onto the cathode sides thereof, and voltage-dividing resistors 60*a* and 61*a* are connected to this connection point, and a signal X is outputted to an element error detection circuit 44*c*, described later, from a point of dividing voltage into the voltage-dividing resistors 60*a* and 61*a*. Likewise, a diode 59*b*, diode 59*d*, and voltage-dividing resistances 60*b* and 61*b* are provided on the side of the electromagnetic solenoid 27*b* and electromagnetic solenoid 27*d*. A signal Y is outputted to an element error detection circuit 44*d* from a point of dividing voltage into the voltage-dividing resistances 60*b* and 61*b*.

A comparator 15*d* is to control operations of the auxiliary power supply 6. An input resistor 45 is connected to a negative-side input terminal of the comparator 15*d*, and a further input resistor 46 is connected to between the positive-side input terminal of the comparator 15*d* and the key switch 2. Signals from the output terminal of the first switching elements 20*c* and 20*d* are inputted to the negative-side input terminal via the input resistance 45 and diodes 47*c* and 47*d*. An output terminal of the comparator 15*d* is inputted to a gate circuit, not shown, of the auxiliary power supply 6. It is arranged such that when the first switching element 20*c* or 20*d* is brought into ON in response to A13 signal or A24 signal, and the rapid power feed is performed, an output logic level of the comparator 15*d* comes to be L, and step-up operation of the auxiliary power supply 6 is stopped.

Current flowing through the electromagnetic solenoid 27*a* or 27*c* and the electromagnetic solenoid 27*b* or 27*d* is detected by current detection resistors 29*c* and 29*d*. Voltage across the current detection resistors 29*c* and 29*d* are inputted to amplifier circuits 43*c* and 43*d* respectively, and an output from the amplifier circuits 43*c* and 43*d* is inputted to element error detection circuits (means) 44*c* and 44*d*. Output signals AN13 and AN24 from the amplifier circuits 43*c* and 43*d*, and error signal outputs ER1 and Er2 from the element error detection circuits 44*c* and 44*d* are inputted to the CPU4*d*. Generation of the error signal outputs ER1 and ER2 cause the alarm display 33, which is driven by the CPU4*d*, to respond to these signals, operate, and indicate the alarm.

Each control signal shown in FIG. 9 is now described. Control signals A1–A4 bring the first switching element 20*a* or 20*d* into conduction to perform a rapid power feed, as well as stop a charging operation of the auxiliary power supply 6 during the rapid power feed. Control signals B1–B4 bring the second switching element 24*c* or 24*d* into conduction to perform the rapid power feed and the subsequent continuous power feed, as well as implement an ON/OFF ratio control to perform an open-valve hold control. Control signals C1–C4 bring selectively the third switching elements 26*a*–26*d* at the time of logic level being H, as well as bring the third switching elements 26*a*–26*d* into a state of open circuit at the time of logic level L to perform interruption at a high speed. Preparing the program shown in the flowchart of FIG. 6 of the second embodiment for four electromagnetic solenoids respectively, and storing the program in the nonvolatile program memory MEM of the CPU4*d* achieve operations of these control signals.

Now, the pair of element error detection circuits (means) 44*a* and 44*b* forming an identical circuit, are described in detail with reference to FIG. 10, taking the element error detection circuit 44*c* as a typical one. Referring to FIG. 10, the element error detection circuit 44*c* includes: a comparator 47*a* acting as short circuit error detection means with respect to the first switching elements 20*c* and 20*d*, or the third switching elements 26*a*–26*d*; a comparator 50*a* acting as short circuit error detection means with respect to the second switching elements 24*c* and 24*d*; a comparator 47*b* acting as disconnection error detection means with respect to the first switching elements 20*c* and 20*d*; and OR elements 54*a* and 54*b* or storage elements 55*a* and 55*b*; which are the same as the element error detection circuit 44*a* in the foregoing of FIG. 8 described according to the third embodiment. FIG. 10 is different from FIG. 8 only in the aspect of constitution of the disconnection error detection means performed by the comparator 50*b* of FIG. 8.

This fourth embodiment is arranged such that, even if the first switching element 20*c* or 20*d* comes to be in a state of a short circuit error, since an open-valve holding control can be made by means of the second switching element 24*c* or 24*d*, the comparator 50*a* does not detect the short circuit error of the first switching element 20*c* or 20*d*. The OR element 62*c* is to input the control signal C1 and C3. A falling edge detection circuit 63 detects that an output from the OR element 62 has changed from logic level H to L. The storage element 55*c* is constituted of, e.g., flip-flop circuit, and set when the falling edge detection circuit 63 outputs a falling edge signal. The mentioned storage element 55*c* is reset in response to a divided voltage provided by the voltage-dividing resistors 60*a* and 61*a* described in FIG. 9, that is, in response to a signal X. The timer 52*c* generates a disconnection error determination output when a set output of the storage element 55*c* is at logic level H over not shorter than a minute predetermined time period.

As described in the foregoing second embodiment and, shown in the characteristic (g) of FIG. 5, in the case where the control signal C has changed from logic level H to L, an induction surge voltage due to inductance of an electromagnetic solenoid is generated as shown in the characteristic (h) of FIG. 5. Accordingly, the above-mentioned surge voltage is divided, applied as a signal X, and reset immediately after the storage element 55*c* has been set by means of the falling edge detection circuit 63. Therefore, it is an extremely short time period that the storage element 55*c* is generating a set output, and the timer 52*c* cannot detect the disconnection error with this instantaneous set output.

However, In case of occurring such a disconnection error that the second switching element and third switching element cannot be turned ON, or the disconnection error at any wiring for the fuel injection valve, any surge voltage signal responding the output signal X from a connection point of the voltage-dividing resistor 60*a* and 61*a* (or an output signal Y from a disconnection point of the voltage-dividing resistors 60*a* and 61*a*) cannot be obtained. Therefore, the storage element 55*c* is not reset and remained to be set by means of the falling edge detection circuit 63. As a result, the disconnection error is stored by means of the storage element 55*b* via the OR element 54*b*.

In this manner, the element error detection circuit 44*c* in FIG. 9 functions to carry out: short circuit error determination of the first switching element 20*a* and short circuit error determination of the third switching elements 26*a* and 26*c* by means of the comparator of FIG. 10; short circuit error determination of the second switching element 24*c* by means of the comparator 50*a*; disconnection error determination of the first switching element 20*c* and step-up error determination of the auxiliary power supply 6 by means of the comparator 47*b*; and disconnection error determination of the second switching element 24*c* or the third switching elements 26*a* and 26*c* by means of the storage element 55*c*. Upon determination, the element error detection circuit 44*c* outputs the error signal ER1.

Likewise, the element error detection circuit 44*d* functions to carry out: short circuit error determination of the first switching element 20*d* and short circuit error determination of the third switching elements 26*b* and 26*d* by means of the comparator 47*a* of FIG. 10; short circuit error determination of the second switching element 24*d* by means of the comparator 50*a*; disconnection error determination of the first switching element 20*d* or step-up error determination of the power supply 6 by means of the comparator 47*b*; and disconnection error determination of the second switching element 24*d* and the third switching element 26*b* and 26*d* by means of the storage element 55*c*. Upon determination, the element error detection circuit 44*c* outputs the error signal ER2.

As described above, the arrangement according to this fourth embodiment is the same as that in FIG. 7 according to the foregoing third embodiment in the following aspect. That is, in this arrangement, when any short circuit error of the first switching elements 20*c* and 20*d*, or the second switching elements 24*c* and 24*d* and third switching elements 26*a*–26*d* is detected by means of the element error detection circuits 44*c* and 44*d*, the gate elements 56*a*–56*d* or 57*a*–57*d* are brought into operation, and the control signals A13, B13, CC1, CC3 and A24, B24, CC2, Cc4 are generated. It is, however, possible that the gate elements 56*a* and 57*a* are removed, the control signal A13 is simply made to be an OR output of control signals A2 and A3, and the control signal A24 is simply made to be an OR output of the control signals A2 and A4. Further, the arrangement according to this fourth embodiment is the same as that in FIG. 7 according to the foregoing third embodiment also in the following aspect. That is, in this arrangement, when any short circuit error or disconnection error of the first switching elements 20*c* and 20*d*, the second switching elements 24*c* and 24*d* or the third switching elements 26*a*–26*d* is detected, the error signal ER1 or ER2 is outputted, and the CPU4*d* causes the alarm display 33 to operate.

In the control device of a fuel injection valve according to the fourth embodiment of the invention having, the above-mentioned arrangement, ON of the key switch 2 brings the CPU4*d* into operation. To drive four fuel injection valves mounted on a four-cylinder internal combustion engine, control signals A1·B1·C1, control signals A2·B2·C2, control signals A3·B3·C3, and control signals A4·B4·C4 are generated in sequence with respect to the electromagnetic solenoids 27*a*–27*d*. The power feed to the electromagnetic solenoids is performed in order of 27*a*→27*b*→27*c*→27*d*→27*a*. Then respective control signals are sorted and organized into the control signals A13·B13·CC1·CC3 and A24·B24·CC2·CC4 by the gate elements 56*a*–56*d* and the gate elements 57*a*–57*d* responding to an operation state associated with the element error detection circuits 44*c* and 44*d*.

The first switching element 20*c* performs the rapid power feed to either one of the electromagnetic solenoid 27*a* and 27*c*, which is selected by the third switching element 26*a* or 26*c* in cooperation with the second switching element 24*c*. During this rapid power feed time period, the control signal A13 is being at a logic level H to cause a valve-opening operation of the fuel injection valve to start. While the first switching element 20*c* is being OFF as well as the second switching element is being ON, a logic level of the control signal B13 is being H continuously, whereby the continuous power feed to the electromagnetic solenoid 27*a* or 27*c* is performed. During this continuous power feed time period, operation of the moving section of the fuel injection valve is terminated and settled.

Subsequently, logic level of the control signal B13 is changed alternately between H and L, and the second switching element 24*c* performs an intermittent operation, whereby an open-valve holding current to the electromagnetic solenoid 27*a* or 27*c* is supplied. A value of this open-valve holding current is set to a current value as small as possible not less than the minimum current value enabling the electromagnetic solenoid 27*a* or 27*c* to hold valve open. The third switching elements 26*a* and 26*c* are subject to selective conduction control in response to the control signals CC1 and CC3, and attenuate speedily an excessive transient-decay current during the open-valve hold time period or reduce a valve-closing operation delay due to gradual transient-decay current to perform the rapid valve-closing operation.

The first switching element 20*d* performs the rapid power feed to either one of the electromagnetic solenoid 27*b* or 27*d*, which is selected by the third switching element 26*b* or 26*d* in cooperation with the second switching element 24*d*. During this rapid power feed time period, the control signal A24 is being at logic level H to start a valve-opening operation of the fuel injection valve. During the time period when the first switching element 20*d* is being OFF as well as the second switching element 24*d* is being ON, logic level of the control signal B24 continues to be H, whereby the continuous power feed to the electromagnetic solenoid 27*b* or 27*d* is performed. During this continuous power feed time period, operation of the moving section of the fuel injection valve is terminated and settled.

Subsequently, logic level of the control signal B24 is changed alternately between H and L, and the second switching element 24*d* performs an intermittent operation, whereby an open-valve holding current to the electromagnetic solenoid 27*b* or 27*d* is supplied. A value of this open-valve holding current is set to a current value as small as possible not less than the minimum current value enabling the electromagnetic solenoid 27*b* or 27*d* to hold valve open. The third switching elements 26*b* and 26*d* are subject to selective conduction be control in response to the control signals CC2 and CC4, and attenuate speedily an excessive transient-decay current during the open-valve hold time period or reduce a valve-closing operation delay due to gradual transient-decay current to perform the rapid valve-closing operation.

When the element error detection circuit 44*c* performs a short circuit error determination of the first switching element 20*c*, second switching element 24*c* or third switching element 26*a* or 26*c* and generates the gate signal output GT1, the control signals A13·B13·CC1. CC3 come to logic level L. Further, the elements, which are not in a state of the short circuit error among the first switching element 20*c*, second switching element 24*c* and third switching elements 26*a* and 26*c*, are brought into non-conduction to stop the operation of a pair of the fuel injection valves, which perform a valve-opening operation alternately at regular intervals. However, the electromagnetic solenoids 27*b* and 27*d*, which drive the other pair of the fuel injection valves, continue operation by means the first switching element 20*d*, second switching element 24*d* and third switching elements 26*b* and 26*d*, thus enabling an evacuation operation.

On the contrary, when the element error detection circuit 44d performs the short circuit error determination of the first switching element 20*d*, second switching element 24*d*, or third switching element 26*b* or 26*d* and outputs the gate signal GT2, the control signals A24·B24·CC2·CC4 come to logic level L. Further, the elements, which are not in a state of the sport circuit error, among the first switching element 20*d*, second switching element 24*d* and third switching elements 26*b* and 26*d*, are brought into non-conduction to stop the operation of a pair of the fuel injection valves, which perform a valve-opening operation alternately at regular interval. However, the electromagnetic solenoids 27*a* and 27*c*, which drive the other pair of the fuel injection valves, continue operation by means of the first switching element 20*c*, second switching element 24*c* and third switching elements 26*a* and 26*c*, thus enabling an evacuation operation.

In this fourth embodiment, when any short circuit error occurs at either one of the first switching elements 20*c* and 20*d*, a step-up operation of the auxiliary power supply 6 is stopped by the action of the comparator 15*d* to prevent the electromagnetic solenoid from being continuously applied with an excessive voltage. Further, operations provided by the main power supply 1, the second switching element 24*c* or 24*d* and the third switching elements 26*a*–26*d* cause all the electromagnetic solenoids 27*a*–27*d* to operate, thus enabling an evacuation operation. Accordingly, it is also preferable that the voltage-dividing resistances 48*c* and 48*d* are excluded at the differential circuit 48 in FIG. 10 so as not to detect the short circuit error at the first switching elements 20*c* and 20*d*.

In addition, even in the case where step-up operation of the auxiliary power supply 6 becomes impossible, or any disconnection error occurs such that the first switching element 20*c* or 20*d* is incapable of being conductive, all the electromagnetic solenoids 27*a*–27*d* are brought into operation by means of the main power supply 1, the second switching element 24*c* or 24*d*, and the third switching elements 26*a*–26*d*, thus enabling to perform an evacuation operation. However, since any delay in operation response of the fuel injection valve occurs in these evacuation operations, a fuel injection with accurate amount cannot be performed. Additionally, the alarm display 33 operates also in response to an error signal output ER corresponding to the step 607 and step 621 of FIG. 6 other than the above-mentioned error signal outputs ER1 and ER2.

As described above, this fourth embodiment makes it possible to obtain a control device of a fuel injection valve possessing the advantages described in the foregoing second embodiment as well as those described in the third embodiment.

As is understood from the above descriptions, in the control device of a fuel injection valve according to the invention, the minimum voltage Vpmin at the end of the rapid power feed by means of the auxiliary power supply 6 is set to be a value larger than the maximum voltage Vb of the main power supply 1 so as to be capable of performing a fuel injection having a stable characteristic even if taking place variation in the main power supply voltage. To suppress the maximum voltage and maximum current applied to the electromagnetic solenoids, switching elements or the like, a voltage distribution of three hierarchical stages of rapid power feed voltage, at which the rapid power feed voltage and main power supply voltage are applied, continuous power feed voltage and open-valve holding voltage, is suitably established. Further, in the case where the electromagnetic solenoids are directly driven from the main power supply 1, an electromagnetic force enabling to perform a valve-opening operation of the fuel injection valve can be generated even if voltage of the Fain power supply is the minimum value Vbmin. In other words, it is so arranged as to be capable of performing an evacuation operation solely by the main power supply 1 even if the auxiliary power supply 6 for the rapid power supply is in fault.

Further, step-up operation of the auxiliary power supply 6 is stopped during the rapid power supply, as well as a plurality of conduction controlling switching elements are connected in series to the fuel injection valves. Thus, it is arranged such that in the case where one of the switching elements comes under a short circuit error, the other switching element is interrupted, thereby preventing the burnout of the fuel injection valve dealing with a dangerous fuel.

In the case of applying the invention to a six-cylinder internal combustion engine, six electromagnetic solenoids are to be used. On the supposition that 27*a*, 27*b*, 27*c*, 27*d*, 27*e*, 27*f* denote respective electromagnetic solenoids, and fuel injections are conducted in this order, three pairs of electromagnetic solenoids of the electromagnetic solenoids 27*a* and 27*d*, the electromagnetic solenoids 27*b* and 27*e*, and the electromagnetic solenoid 27*c* and 27*f* are composed. Then using three first switching elements, three second switching element and six third switching elements, it becomes possible to perform a power feed control. As a result of such combination as described above, power feed time period of a pair of the electromagnetic solenoids is not overlapped, making it possible to share or commonly use the first and second switching elements. Consequently, vibration due to irregular rotation of engine is suppressed in the evacuation operation without the cylinder in case of occurrence of error.

In the case of increasing dependence on the control by means of the CPU as for the power feed control with respect to the electromagnetic solenoid, it is a feature of the invention that processing any change in control specification can be easily implemented with the use of software. However, a control performance of the CPU tends to be deteriorated. Thus, it is desirable in practical use that any control required for a high-speed response such as feedback control to hold valve open with respect to the electromagnetic solenoid, or a short circuit error detection are implemented using the hardware; while any control, of which operation frequency is comparatively low such as switching timing signal with respect to the electromagnetic solenoid or error display, is implemented with the use of CPU. It is also possible that the CPU performs an alarm display in accordance with types of occurred errors, or stores history information, read-out and utilize the stored information as maintenance management information.

According to each embodiment described above, the second switching element is fully brought into conduction during the continuous power feed time period. However, an OFF time period proportional to a voltage fluctuation scale in the main power supply 1, that is, Vbmax-Vbmin is provided. Thus, when voltage of the main power supply is at the minimum value Vbmin, the second switching elements is brought into a full conduction to perform the continuous power feed in which influence of the voltage variation in the main power supply 1 is reduced, thereby enabling to suppress heat generation of the electromagnetic solenoids. Furthermore, in the case where voltage stepping up function of the auxiliary power supply 6 comes to be in fault and a high voltage for the rapid power feed cannot be obtained, not only valve-opening drive time period is extended to apply the whole voltage of the main power supply 1, but also a fuel injection time period is shortened to be capable of implementing such evacuation operation as is low in engine speed of the internal combustion engine. Particularly, in an internal combustion engine of an electronic throttle-type in which operations of opening and closing an air intake valve is carried out by an electromotive motor, it is possible to perform a safe evacuation operation by suppressing the opening of the air intake valve.

Although the auxiliary power supply 6 performs the operation of stepping up voltage due to ON/OFF of the induction element, it is possible that an induction element (transformer) including a secondary winding instead of the induction element is employed, and a high voltage generated at the secondary winding when a power feed current to the induction element is ON/OFF is supplied to the capacitor 9 via the diode. Further, when any disconnection error occurs at the switching element, merely the alarm display 33 is brought into operation, and an evacuation operation without the cylinder is carried out under the state of stopping only the cylinder where the trouble has occurred, thereby preventing a significant reduction in output from the internal combustion engine. However, it is also possible to interrupt conduction to the electromagnetic solenoids forming a pair eventually thereby suppressing an unbalanced rotation vibration in evacuation operation without the cylinder at the time of occurrence of the disconnection error in the same manner as at the time of occurrence of the short circuit error.

In the invention, the element error detection circuit performs a short circuit error determination of the third switching element when a differential value of an excitation current at the time of the rapid power feed is excessively large; the element error detection circuit also performs a short circuit error determination of the first switching element when an excitation current at the time of the rapid power feed is excessively large; and the element error detection circuit determines a short circuit error of the second switching element when an excitation current during the open-valve hold time period is excessively large; the element error detection circuit further performs a disconnection error determination of the first and third switching elements when a differential value of an excitation current at the time of the rapid power feed; the element error detection circuit still further performs a disconnection error determination of the second and third switching elements when an excitation current during the open-valve hold control time period is excessively small; or the element error detection circuit yet further performs a disconnection error determination of the second and third switching elements by monitoring the presence or absence of a surge voltage generated at the time of interrupting an excitation current to the electromagnetic solenoid at a high speed.

Thus, it is arranged according to the invention so as to be capable of determining any short circuit error or disconnection error of each switching element as to all of the first switching element, second switching element and a pair of third switching elements. However, error of the auxiliary power supply 6 or disconnection error of the first switching element can be detected by step 306 or step 319 of FIG. 3, or step 607 or step 621 of FIG. 6; and the step-up operation of the auxiliary power supply 6 can be stopped by means of the comparator 15*c* or 15*d* shown in FIG. 7 or 9 at the time of any short circuit error of the first switching element. Consequently, it is also possible to omit the short circuit error detection or disconnection error detection as to the first switching element in the element error detection circuit.

While the presently preferred embodiments of the present invention have been shown and described, it is to be understood that these disclosures are for the purpose of illustration and that various changes and modifications may be made without departing the spirit and scope of the invention as set forth in the appended claims.

What is claimed is:

1. A control device for controlling a fuel injection valve comprising:

an auxiliary power supply for stepping up voltage from a main power supply mounted on a vehicle;

a first switching element for conducting voltage from said auxiliary power supply to an electromagnetic solenoid for driving a fuel injection valve;

a second switching element for conducting voltage from said main power supply to said electromagnetic solenoid;

a third switching element that possesses a withstanding voltage limiting characteristic larger than a maximum output voltage from said auxiliary power supply, and interrupts a supply current to said electromagnetic solenoid at a high speed;

current detection means for detecting conduction current to said electromagnetic solenoid;

valve-opening signal generation means for inputting an operation information of an internal combustion engine and outputting a valve-opening signal and a valve-opening drive signal corresponding to a valve-opening time and a valve-opening time period of said fuel injection valve; and conduction control means for controlling a power feed to said electromagnetic solenoid in response to a signal of said valve-opening signal generation means;

wherein said conduction control means performs a rapid power feed from said auxiliary power supply to said electromagnetic solenoid by means of said first switching element in response to the valve-opening drive signal from said valve-opening signal generation means;

said conduction control means performs a continuous power feed from said main power supply by means of said second switching element;

said conduction control means performs a hold power feed under ON/OFF control of said second switching element by feedback control based on a current value detected by said current detection means during continuance of said valve-opening signal after said valve-opening drive signal has ended;

said conduction control means interrupts a power feed to said electromagnetic solenoid at a high speed by means of said third switching element immediately after said valve-opening signal has ended; and minimum value of an output voltage from said auxiliary power supply is set to be larger than a maximum value of voltage of said main power supply, and a step-up operation of said auxiliary power supply is stopped during said rapid power feed.

2. The control device of a fuel injection valve according to claim 1, wherein said auxiliary power supply comprises an induction element to which an electric power is fed from said main power supply via an exciting switching element and a capacitor for charging a voltage generated at said induction element due to open circuit of said exciting switching element; and said exciting switching element comes to be OFF and the capacitor stops charging when voltage of said capacitor has reached a predetermined value and during continuance of said valve-opening drive signal being a sum of said rapid power feed and said continuous power feed.

3. The control device of a fuel injection valve according to claim 1, further comprising rapid power feed detection means for detecting said rapid power feed;

wherein said rapid power feed detection means is constituted of a comparator that compares a first voltage proportional to a voltage at said main power supply with a second voltage proportional to an output voltage from said first switching element and outputs a rapid power feed detection signal when said second voltage becomes larger than said first voltage;

and said exciting switching element is brought into a OFF state to stop a step-up operation in response to an input of said rapid power feed detection signal.

4. The control device of a fuel injection valve according to claim 1, wherein, on the assumption that a holding current conducted to said electromagnetic solenoid at the time of said holding power feed is Ih; a wire wound resistance of said electromagnetic solenoid is R; a holding voltage applied to said electromagnetic solenoid at the time of conducting said holding current is Vh=Ih×R; an average voltage of said auxiliary power supply applied to said electromagnetic solenoid at the time of performing said rapid power feed is Vpa; and voltage of said main power supply applied to said electromagnetic solenoid at the time of performing said continuous power feed, a relation among respective applied voltages satisfies the following expression:

$$(Vb\max/Vh)^2>(Vpa/Vh)>(Vb\min/Vh)^2.$$

5. The control device of a fuel injection valve according to claim 1, wherein a first switching element for performing a rapid power feed from said auxiliary power supply and a second switching element for performing a continuous power feed and a hold power feed form said main power supply, are connected in parallel to said electromagnetic solenoid; and a back-flow prevention diode, which prevents inflow of said rapid power feed, is connected in series to said second switching element.

6. The control device of a fuel injection valve according to claim 1, wherein said first switching element and said second switching element are connected in series to said electromagnetic solenoid; said first switching element and said second switching element are brought into conduction, thereby performing said rapid power feed; and said continuous power feed is performed when said first switching element is not in conduction and only said second switching element continues to be conductive.

7. The control device of a fuel injection valve according to claim 5, further comprising first comparison means for determining that a conduction current to said electromagnetic solenoid detected by said current detection means has exceeded a first threshold being a predetermined peak current value;

wherein said first comparison means outputs a first determination signal to bring said first switching element into OFF when said first comparison means determines said threshold excess, and ends said rapid power feed.

8. The control device of a fuel injection valve according to claim 7, wherein said valve-opening drive signal is generated in response to said valve-opening signal, as well as set to end during said valve-opening signal being continued; and a continuous power feed by means of said second switching element is applied to the electromagnetic solenoid during continuance of said open-valve drive signal after said first comparison means has determined that a conduction current has exceeded a threshold.

9. The control device of a fuel injection valve according to claim 8, further comprising: a second comparison means for determining that a conduction current to said electromagnetic solenoid detected by said current detection means has drops below a second threshold larger than the minimum current required for holding an open valve of the electromagnetic solenoid and outputting a second determination signal;

wherein said third switching element is being OFF until a determination signal is outputted by said second comparison means after said valve-opening drive signal has ended.

10. The control device of a fuel injection valve according to claim 9, wherein said conduction control means includes holding current control means for controlling current at the time of said hold power feed; during a time period from ending said valve-opening drive signal until ending of said valve-opening signal, said holding current control means detects a lower limit corresponding to a minimum current value required for holding an open valve of said fuel injection valve, and an open-valve holding current upper limit larger than said lower limit by a predetermined value to perform an ON/OFF control of said second switching element, and performs an open-valve holding of said fuel injection valve; and during a time period from outputting the determination signal by means of said second comparison means until ending said valve-opening signal, said third switching element is held in an ON state.

11. The control device of a fuel injection valve according to claim 7, further comprising at least one of first and second comparison amplifiers for comparing outputs from said current detection means;

wherein said first comparison amplifier is constituted of a positive feedback circuit that outputs an operation signal when a conduction current to said electromagnetic solenoid exceeds said first threshold, thereby establishing said first determination signal, and stops an operation signal in the case of dropping below said second threshold, thereby establishing said second determination signal; said first comparison amplifier acts as an alternative of said first comparison means and second comparison means; said second comparison amplifier is constituted of a positive feedback circuit that outputs an operation signal when exceeding a threshold corresponding to said open-valve holding current upper limit, and stops an operation signal to perform the ON(OFF control of said second switching element when dropping below said minimum current value necessary for holding said open-valve; and said second comparison amplifier acts as an alternative of said holding current control means.

12. The control device of a fuel injection valve according to claim 5, further comprising:

auxiliary power supply error detection means for detecting that an output voltage from said auxiliary power supply does not reach a predetermined value after a predetermined time period has passed since turning on an electric power from said main power supply, and outputting an error signal; and auxiliary power supply error processing means for extending a valve-opening time period by making an end time of said valve-opening drive signal later or making an output time of said valve-opening signal earlier when said auxiliary power supply error detection means outputs an error signal.

13. The control device of a fuel injection valve according to claim 5, further comprising:

rapid power feed error determination means for performing an error determination when a conduction current to said electromagnetic solenoid does not exceed said first threshold after a predetermined time period has passed from ON of said first switching element; and rapid power feed error processing means for extending a valve-opening time period by making an end time of said valve-opening drive signal later or making an output time of said valve-opening signal earlier when said auxiliary power supply error detection means outputs an error signal.

14. The control device of a fuel injection valve according to claim 1, wherein said fuel injection valve is provided individually at each cylinder of a multi-cylinder internal combustion engine; and said auxiliary power supply is commonly used as a power supply for the rapid power feed to the electromagnetic solenoid of a plurality of said fuel injection valves.

15. The control device of a fuel injection valve according to claim 5, wherein said fuel injection valve is provided individually at each cylinder of a multi-cylinder internal combustion engine; said first switching element, said second switching element and said current detection means are commonly used with respect to a pair of electromagnetic solenoids that performs a valve-opening operation alternately at regular intervals; and said third switching element is connected in series to each electromagnetic solenoid.

16. The control device of a fuel injection valve according to claim 15, further comprising element error detection means for outputting an error determination signal when a detection current value by means of said current detection means is excessively large, wherein said element error detection means stops operations of said first switching element and second switching element connected commonly to a pair of electromagnetic solenoids, and said third switching element connected in series to each electromagnetic solenoid when said element error detection means determines that a detection current value is excessively large.

17. The control device of a fuel injection valve according to claim 16, wherein said element error detection means comprises short circuit error detection means, and said short circuit error detection means outputs a short circuit error determination signal when a building-up differential value of a detection current by means of said current detection means is excessively large, when current of said rapid power feed is excessively large, or when a holding current is excessively large at the instant of operation start of the feedback control means for controlling feedback of said hold power feed.

18. The control device of a fuel injection valve according to claim 16, wherein said element error detection means comprises disconnection error detection means, and said disconnection error detection means outputs a disconnection error determination signal when said current detection means cannot detect a current in a state that any of said first switching element, said second switching element or said third switching element should be ON, or when a current value at the time of said rapid power feed is excessively small, and when any surge voltage is not generated across said third switching element at the time of opening circuit of said third switching element.

19. The control device of a fuel injection valve according to claim 17, wherein said element error detection means comprises an alarm display, and when said short circuit error detection means outputs a short circuit error determination signal, said alarm display displays an alarm in response to said signals.

20. The control device of a fuel injection valve according to claim 18, wherein said element error detection means comprises an alarm display, and when said disconnection error detection means outputs a disconnection error determination signal, said alarm display displays an alarm in response to said signals.

* * * * *